US009088843B2

(12) United States Patent
Ettinger

(10) Patent No.: US 9,088,843 B2
(45) Date of Patent: Jul. 21, 2015

(54) SPEAKER SYSTEM

(75) Inventor: Adam Todd Ettinger, Venice, CA (US)

(73) Assignee: Adam Todd Ettinger, Venice, CA (US)

( * ) Notice: Subject to any disclaimer, the term of this patent is extended or adjusted under 35 U.S.C. 154(b) by 961 days.

(21) Appl. No.: 13/251,239

(22) Filed: Oct. 1, 2011

(65) Prior Publication Data

US 2012/0170782 A1 Jul. 5, 2012

(51) Int. Cl.
*H04R 1/02* (2006.01)

(52) U.S. Cl.
CPC ..... *H04R 1/028* (2013.01)

(58) Field of Classification Search
CPC .... H04R 1/1041; H04R 1/105; H04R 1/1066; H04R 1/1083; H04R 2201/103; H04R 2201/107; H04R 2201/109; H04R 2205/022; H04R 2420/03; H04R 2420/07; H04R 2420/09; H04R 3/12; H04R 5/033; H04R 1/02; H04R 1/021
USPC ..... 381/332, 394, 87, 361, 390, 386, 387, 381/389, 384; 181/198, 199, 148, 150, 171, 181/145
See application file for complete search history.

(56) References Cited

U.S. PATENT DOCUMENTS

| | | | | |
|---|---|---|---|---|
| 4,666,276 | A * | 5/1987 | Chan | 396/180 |
| 8,311,262 | B2 * | 11/2012 | Kulchy et al. | 381/394 |
| 2010/0303277 | A1 * | 12/2010 | King et al. | 381/394 |
| 2012/0008811 | A1 * | 1/2012 | Edwards et al. | 381/332 |
| 2012/0300966 | A1 * | 11/2012 | Stewart et al. | 381/332 |

OTHER PUBLICATIONS

U.S. Appl. No. 14/591,858, filed Jan. 7, 2015, 62 pages.
U.S. Appl. No. 14/591,858 / Preliminary Amendment, filed Jan. 7, 2015, 7 pages.
U.S. Appl. No. 13/844,702, filed Mar. 15, 2013, 42 pages.
U.S. Appl. No. 13/844,702 / Filing Receipt, mailed May 15, 2013, 3 pages.
U.S. Appl. No. 13/844,702 / Notice to File Missing Parts, mailed May 15, 2013, 4 pages.
U.S. Appl. No. 13/844,702 / Abandonment, Jan. 22, 2014, 2 pages.
U.S. Appl. No. 13/933,063, filed Jul. 1, 2013, 61 pages.
U.S. Appl. No. 13/933,063 / Notice to File Missing Parts, mailed Jul. 26, 2013, 2 pages.
U.S. Appl. No. 13/933,063 / Filing Receipt, mailed Jul. 26, 2013, 3 pages.
U.S. Appl. No. 13/933,063 / Abandonment, Apr. 1, 2014, 2 pages.

* cited by examiner

*Primary Examiner* — Lun-See Lao
(74) *Attorney, Agent, or Firm* — Berkeley Law & Technology Group, LLP

(57) ABSTRACT

A speaker system comprises a plurality of modules, each having an enclosure. One enclosure is a speaker enclosure that houses at least one outwardly facing driver. At least one other enclosure encloses electronic components for wirelessly receiving audio and driving at least one driver. The electronic components may be distributed among many modules. The modules are mechanically and electrically connected to each other through mounts. At least one half of a mount is connected to each enclosure. Each mount has a first half and a second half. The first half of any mount can be mechanically connected to the second half of any other mount. Each mount half includes electrical contacts that align when two halves are connected. So when the mounts of each enclosure are mechanically connected, the electronics are electrically coupled to form a circuit that wirelessly receives audio, amplifies it, and drives the driver.

32 Claims, 26 Drawing Sheets

SPEAKER SYSTEM

BACKGROUND

Over the years there are have been efforts to improve speakers and, more generally, audio systems. For example, some audio systems are wireless and audio can be streamed from a computer to the speaker system. Other efforts have been made to reduce the size of the speaker enclosure and driver while maintaining the fidelity provided by a large speaker having multiple drivers. Additional efforts have been made to design enclosures and speakers that reproduce audio with increased clarity, volume, range, and fidelity. And, whether considered a large or a small speaker, efforts have been made to design speaker systems that are more attractive than the tried-and-true box design.

Nevertheless, despite the ambitions and combined efforts of audiophiles, speaker designers, audio component manufacturers, and others in the field, a few facts remain: speakers that faithfully reproduce sound are generally considered unattractive, speakers that are considered attractive or are small enough in size to be hidden do not pass the test of hi-fidelity audio reproduction demanded by consumers today, speakers that perform well must be awkwardly connected by wires to bulky and ugly equipment, and speakers that integrate amplifiers and other electronic components so little if any external connections are necessary are only as good as the worst component of the integrated system and fixed in their configurations.

Moreover, speaker system manufacturers and manufacturers of speaker mounts have made considerable efforts to innovate designs for speaker mounts so that speakers systems can be less obtrusive. These designs suffer from requiring unsightly wires. Further, prior art speaker mounts (sometimes referred to as brackets) are often difficult to attach to the rest of the speaker system and to walls. Consumers also find it difficult and time consuming to dismount the speakers swiftly and easily. Thus, consumers find it necessary to by one set of stationary speakers for each location in the home or office where they wish to listen to music, as well as a portable radio or other mobile audio system if they want to take their music from room to room or on a trip.

Thus, a need presently exists for a speaker system that solves these and other problems.

SUMMARY

A speaker system comprises at least at least one mount having two halves, a first half mount and a second half mount. The first half mount comprises electrical contacts. The second half mount comprises electrical contacts that align with the electrical contacts of the first half of each of the at least one mounts when the first half and the second half are connected to each other. A plurality of electronic elements comprises an audio receiver, an amplifier, and a power supply. A plurality of modules comprises a first module and at least one additional module. The first module comprises a speaker enclosure having a first end comprising an opening, a second end, an intermediate section connecting the first end to the second end, an exterior surface, and an interior surface that defines the interior of the speaker enclosure. A driver is attached to the opening of the first end of the speaker enclosure. At least one half of at least one mount is connected to the speaker enclosure, and the driver is electrically coupled to electrical contacts of the at least one half. Each additional module comprises an enclosure. At least one half of at least one mount is connected to the enclosure. At least one of the electronic elements is enclosed by the enclosure and electrically coupled to electrical contacts of the at least one half of at least one mount. Each of the plurality of modules is mechanically attached to at least one other module. The plurality of modules are mechanically attached when a module's first half mount is attached to another module's second half mount. The audio receiver is electrically coupled to the amplifier, the amplifier is electrically coupled to the driver, and the power supply is electrically coupled to supply power to at least the amplifier.

DETAILED DESCRIPTION

Figure 1:
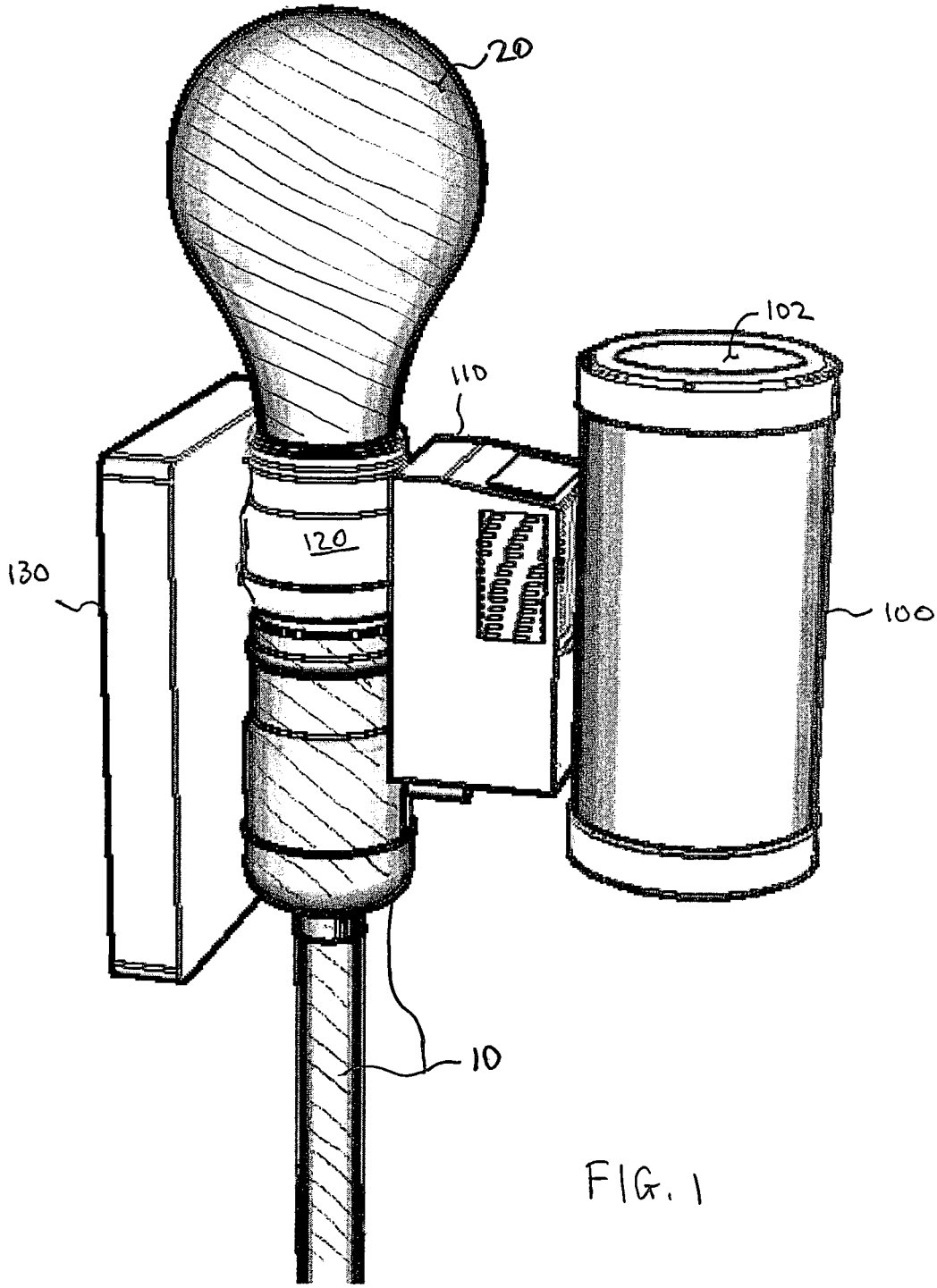
FIG. 1 is an exemplary perspective view of a speaker system connected to a prior art lamp.
Figure 9:
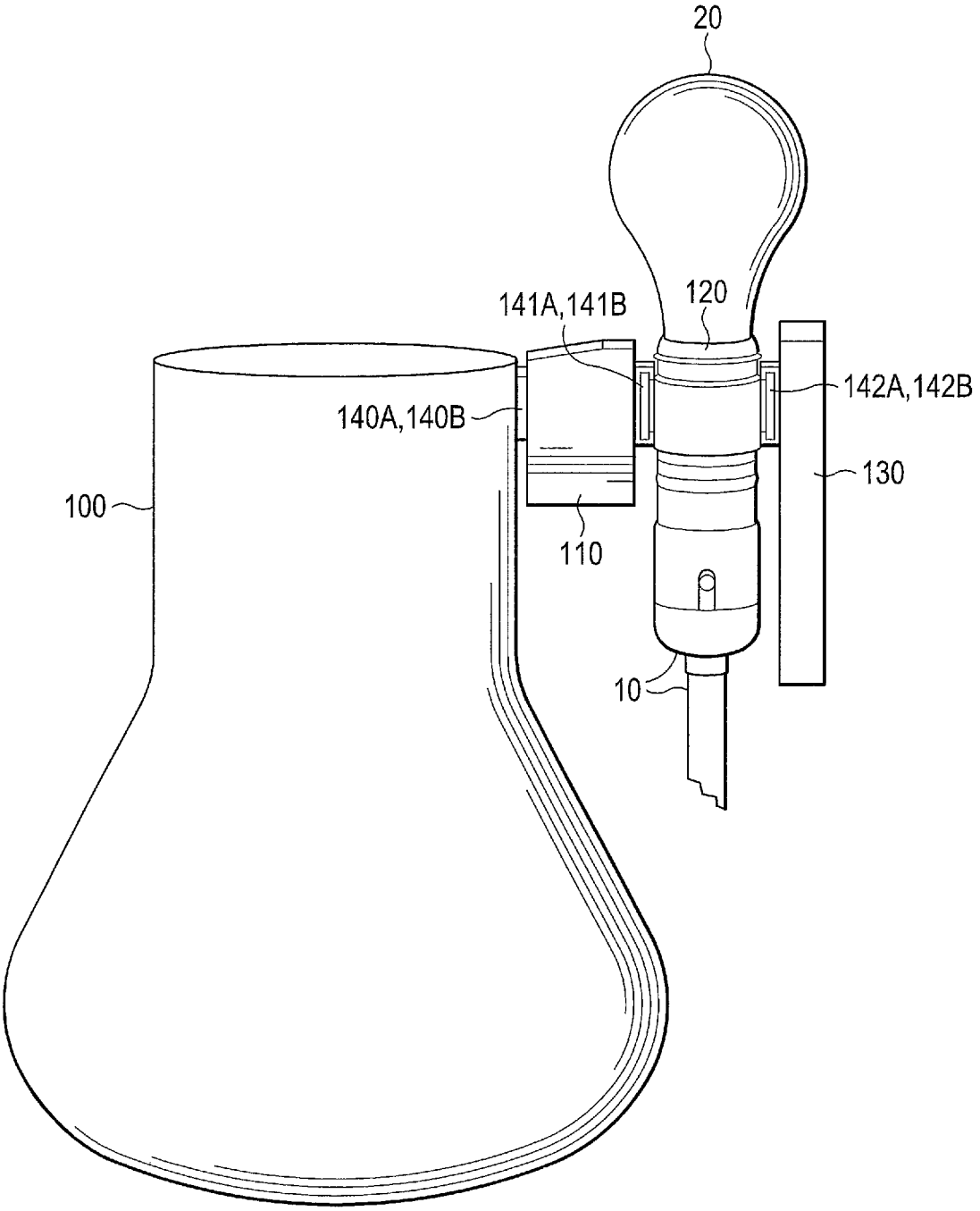
FIG. 9 is an exemplary side view of a speaker system connected to a prior art lamp.

FIG. 1 is an exemplary perspective view of a speaker system connected to a prior art lamp. FIG. 9 is a side view of an equivalent speaker system. In this configuration, the speaker system includes first module 100 comprising an outwardly facing driver (also referred to herein as a "speaker") 102. The first module is connected to a second module 110 comprising at least a battery. The second module 110 is connected to a lamp adapter 120, and the lamp adapter 120 is connected to a third module 130 comprising electronics such as an audio receiver and amplifier.

Briefly, audio is received wirelessly and amplified by the electronics housed by the third module 130. The amplified audio is coupled to the driver 102 through mounts (140A, 140B of FIGS. 2 and 9; 142 comprising 142A, 142B of FIGS. 2 and 9; 141A, 141B not visible in FIG. 2 but illustrated in FIG. 9) connecting modules 100, 110, 120, 130 and pass-through electrical conductors in the lamp adapter 120 and second enclosure 110.

The audio (or, in other terminology, the acoustic sound waves) is projected upwards from the first module 100. By transmitting the audio upwards, towards a ceiling for example, the ceiling is made to function as a diffuser, beneficially reflecting the audio throughout the room in which the speaker system is placed, producing a sound stage that surrounds and immerses a listener in the audio, and generally enhancing the qualities of the audio transmission so that it is experienced as an omnidirectional source.

Power for the electronics of the third module 130 is supplied by the battery of the second module 110. Additionally, the second module may include power adapter which supplies power and to the electronics and charges the battery. The power adapter receives power from the lamp adapter 120. The lamp adapter 120 screws in to a prior art lamp base 10 and accepts a prior art light bulb 20.

Figure 8:
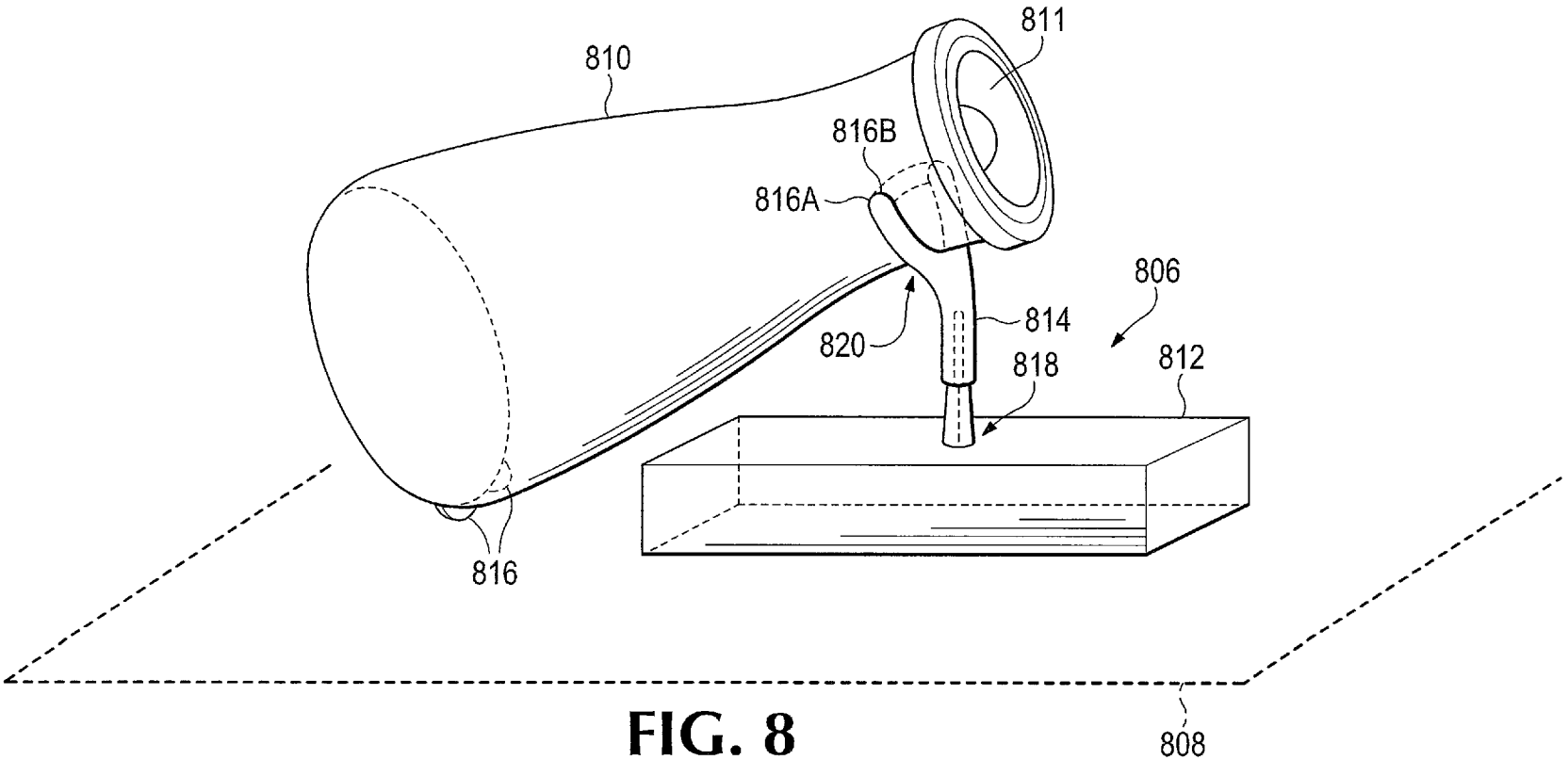
FIG. 8 shows the speaker system including a base.

The speaker system may also be configured without the lamp adapter. In such a configuration, the first module 100 is connected to the second module 110 which is connected to the third module 130. Audio is received and amplified by electronics of the third module 130. The amplified audio is coupled the driver 102 and the audio is projected from the driver 102 as described above. Power is supplied by the battery of the second module 110. In this way, the speaker system is a completely wireless speaker system. FIG. 8 shows an exemplary configuration without a lamp adapter.

Figure 2:
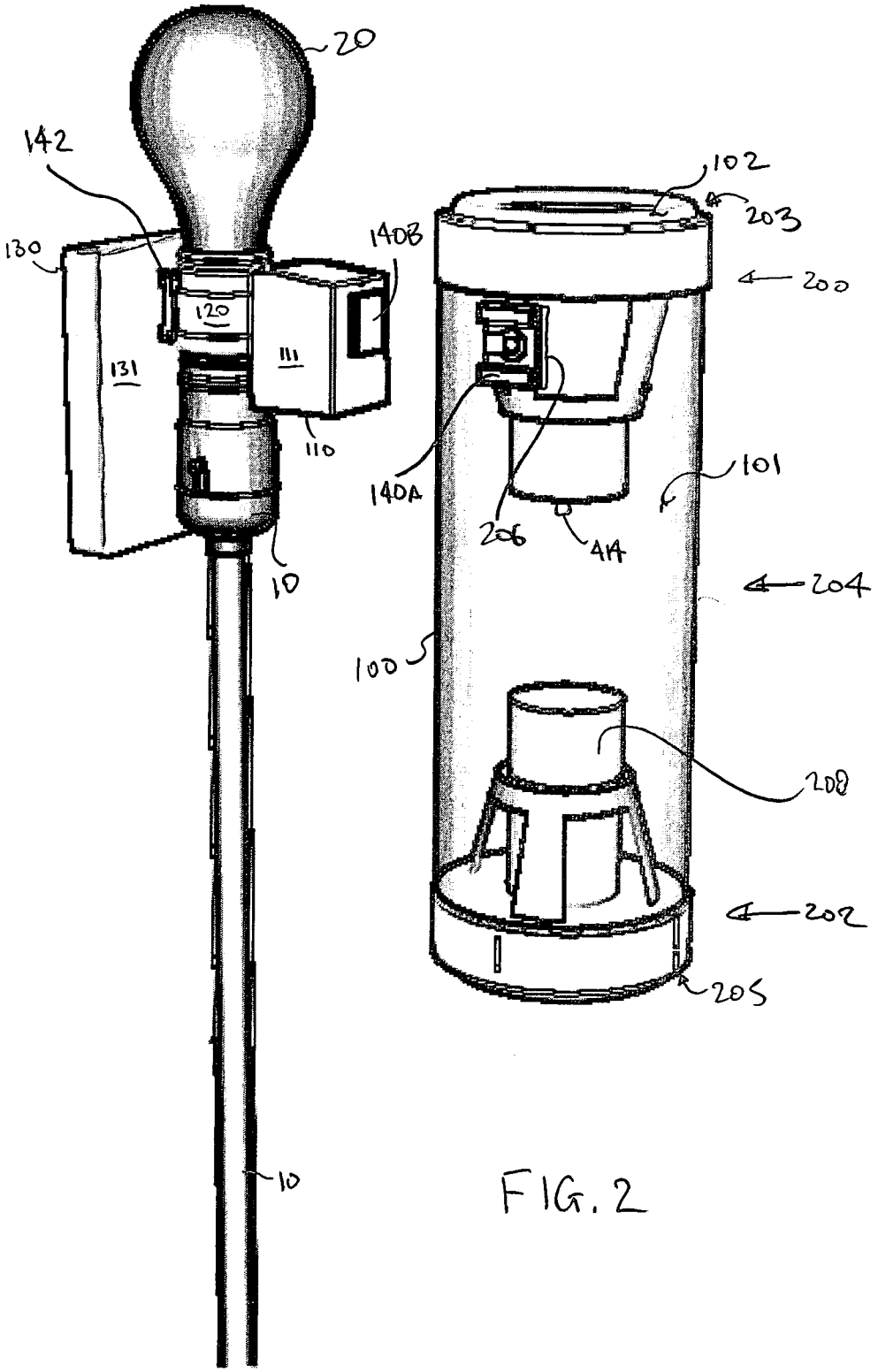
FIG. 2 is an exemplary perspective view of a speaker system connected to a prior art lamp and showing mounts which connect modules of speaker system.

The modules 100, 110, 120, and 130 are connected by way of mounts 140 as shown in FIG. 2. Each mount has a first half 140A and second half 140B. The second half 140B of the mount slides within a channel of the first half 140A, thereby interlocking the two halves. When the halves are interlocked, a mechanical connection is formed that connects the modules together. Furthermore, each half 140A and 140B includes electrical contacts that align when the halves are connected. The electrical contacts conduct electrical signals and power between the modules. In one example, the mount 140 is a hot shoe mount as shown in FIGS. 3A-D. Hot shoe mounts are understood by those having ordinary skill in the art. and are further defined by the International Standards Organization, ISO 518:2006 which is hereby incorporated by reference (http://www.iso.org/iso/iso_catalogue/catalogue_ics/catalogue_detail_ics.htm?ics1=37&ics2=040&ics3=10&csnumber=36330).

Figure 3A:
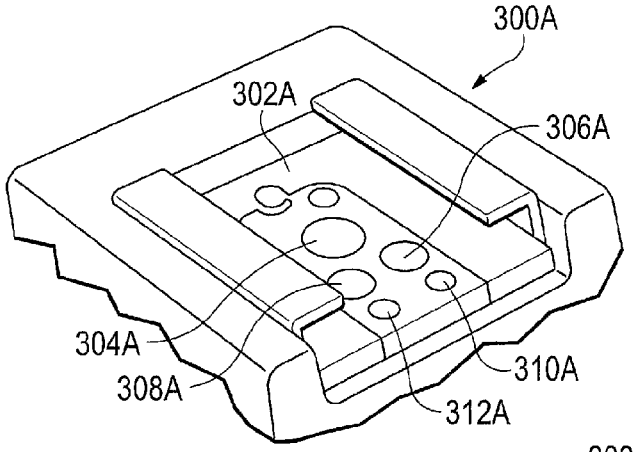
FIG. 3A is a perspective view of a first half of a mount with six electrical contacts.
Figure 3B:
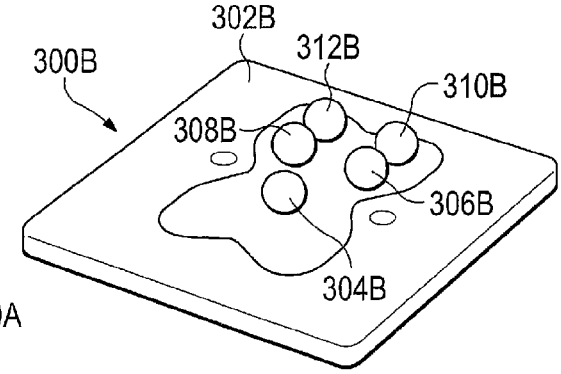
FIG. 3B is a perspective view of a second half of a mount with six electrical contacts.
Figure 3C:
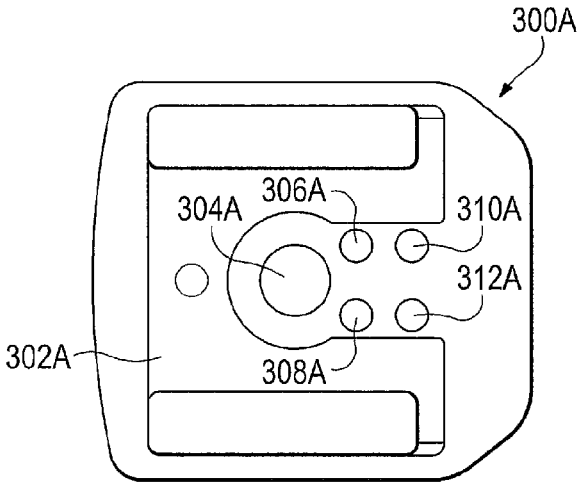
FIG. 3C is a top view of a first half of a mount with six electrical contacts.
Figure 3D:
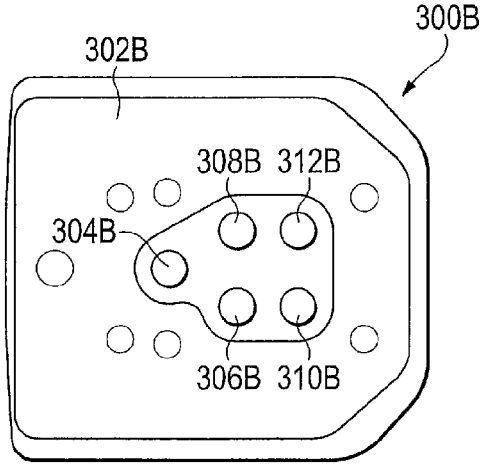
FIG. 3D is a top view of a second half of a mount with six electrical contacts.

FIG. 3A is a perspective view of a first half 300A of a mount with six electrical contacts 302A, 304A, 306A, 308A, 310A, 312A. FIG. 3C is a top view of the first half 300A. FIG. 3B is a perspective view of a second half of a mount 300B with six electrical contacts 302B, 304B, 306B, 308B, 310A, 312B that correspond with the electrical contacts 302A, 304A, 306A, 308A, 310A, 312A of the first half 300A. FIG. 3D is a top view of the second half 300B As will be appreciated by those having ordinary skill in the art, when the first half 300A and second half 300B are engaged, the electrical contacts of the first half and the electrical contacts of the second half are connected to each other. In one example, contacts 300A/300B are connected to system ground; contacts 304A/304B are connected to the aforementioned battery positive side to distribute power; contacts 306A/308B transmit the amplified audio signal; and 310B/312B transmit other analog or digital signals, depending on the configuration.

The hot shoe mount disclosed above is only one of many types of mounts that may be used. Equivalent mounts provide a mechanical connection between the two halves that, when engaged, align a plurality of electrical contacts for communicating electrical signals and power. Mounts may comprise many different shapes, materials, magnets, connectors, springs, detents, channels, threads, and the like, and the halves may engage and disengage according to any mount design available or known by those skilled in the art. Other equivalent mounts include connectors that are commonly used by those in the art, in any configuration, to connect components of an audio system, such as but not limited to any type of speaker terminal, binding posts, spring terminals, slide connectors, and the like, and including the wires, cables, conductors, bare wire ends, and any plugs (e.g. banana plug, angled pins, slide connectors, spade connectors) that connect one speaker terminal or equivalent to another.

Furthermore, the following patents and patent applications are hereby incorporated by reference: U.S. Pat. No. 4,249,813 filed on Jul. 25, 1979; U.S. Pat. No. 4,595,267 filed on Jun. 3, 1982; U.S. Pat. No. 4,666,276 filed on Sep. 10, 1985; and U.S. patent application Ser. No. 12/635,781 filed on Dec. 11, 2009.

Figure 4:
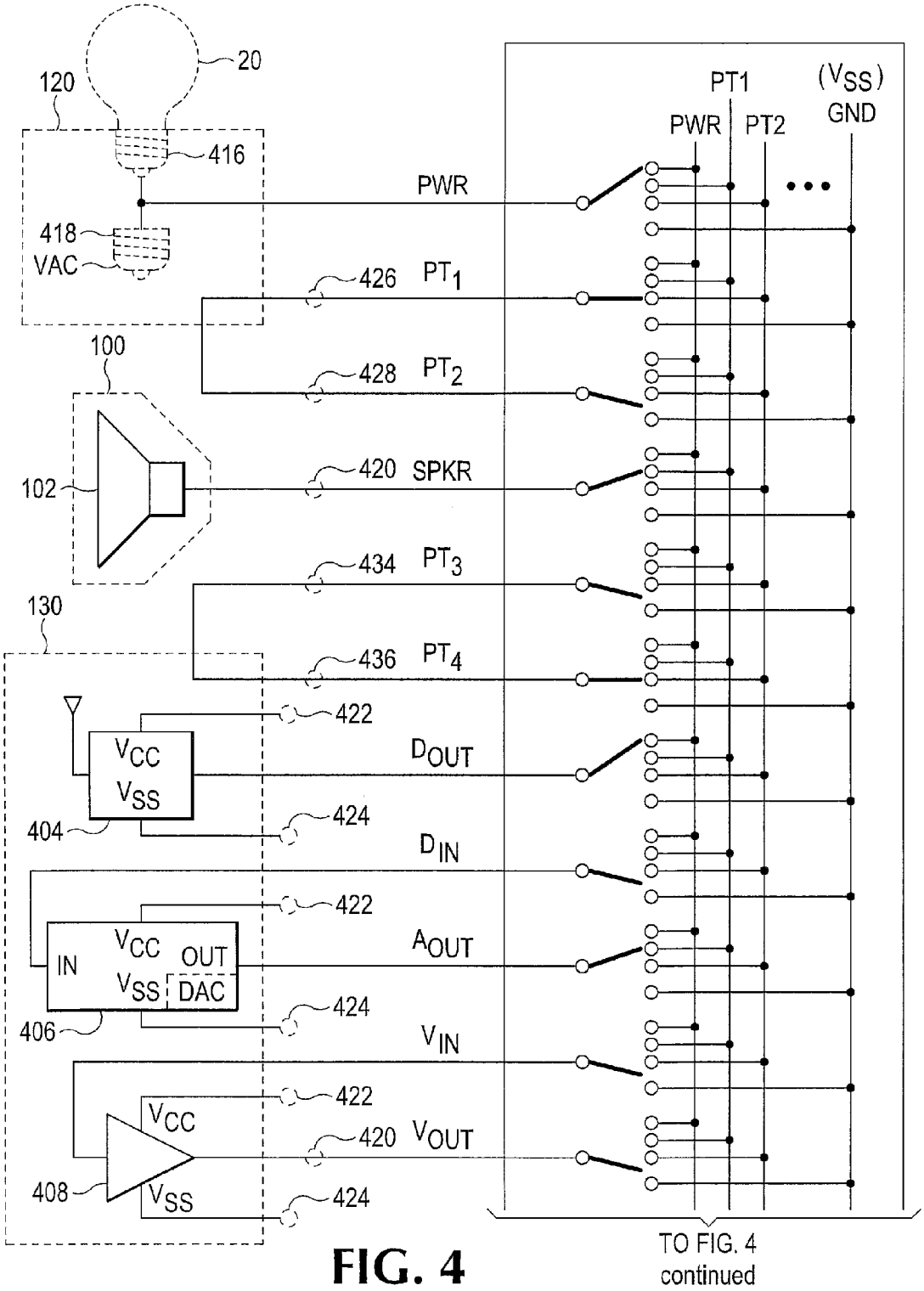
FIG. 4 is a diagram showing schematic elements of the speaker system and a hypothetical switching matrix included to illustrate that the elements may configured in many different ways.
Figure 4:
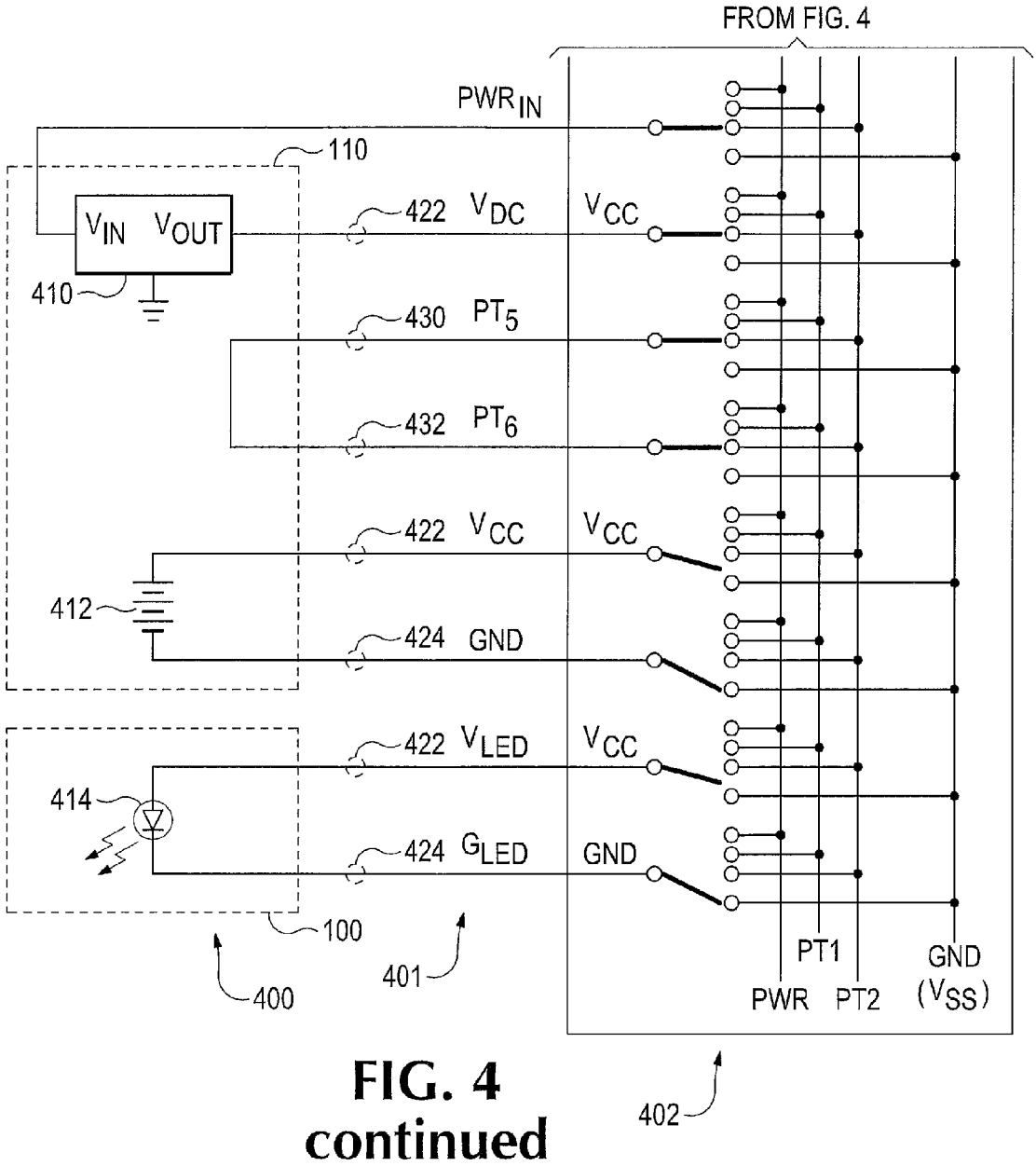

Next, FIG. 4 is a diagram showing schematic elements of the speaker system and a hypothetical switching matrix included to illustrate that the elements may configured in many different ways. FIG. 4 is intended to illustrate a multiplicity of electrical configurations among elements of the speaker system. FIG. 4 further illustrates one physical configuration of the elements of the speaker system, as shown in FIG. 1 and disclosed herein.

It examining FIG. 4, it must be understood that FIG. 4 is an illustration intended to symbolically represent the components of the speaker system and their electrical connections and relationship to each other. Only elements pointed to by arrow 400 and not shown as a dashed line are elements of the speaker system.

The speaker system includes an audio receiver which, in the example of FIG. 4, includes a wireless transceiver 404, audio decoder 406, audio amplifier 408, battery 412, and driver 102. The speaker system may also include a light source such as light emitting diode (LED) 414. The speaker system may further include a lamp adapter comprising a first connector 418 that can be connected to a power source that powers a light fixture and second connector that 416 that can be connected to a lamp 20. The speaker system may additionally comprise a power adapter 410.

The elements illustrated with a dashed line and pointed to by arrow 400 are shown as one example of how the elements 102, 404, 406, 408, 410, 412, 414, 416, 418 are physically arranged with respects to the modules 100, 110, 120, 130 of FIGS. 1 and 2. It is understood that this arrangement is presented by way of example and, with knowledge of this disclosure, it is now appreciated that many other configurations are possible.

Signals pointed to by arrow 401 may be internal to the modules 100, 110, 120, 130, or external. External signals are connected to electrical contacts of a mount or mounts of the module 100, 110, 120, 130 comprising the element 102, 404, 406, 408, 410, 412, 414, 416, 418 and their corresponding signal.

In one example, such external signals and their electrically conductive relationship to each other are illustrated as dashed circles labeled 422, 424, 426, 428, 430, 432, 434, 436. This is illustrated as just one example, and with knowledge of this disclosure, those skilled in the art will appreciate that many configurations are possible.

It is further noted that each of the signals 401 while illustrated by a single line, are symbolic representations of physical conductors that may include more that than conductor. For example, SPKR typically comprises two conductors.

Furthermore, switch 402 of FIG. 4 is shown for symbolic purposes only and is not to be interpreted as a physical element of the speaker system. The switch 402 is merely shown to represent the many electrical connections that are possible in the absence of any physical requirements imposed by the modules illustrated in FIG. 1. That is, for all signals—internal and external—of the elements 102, 404, 406, 408, 410, 412, 414, 416, 418 that comprise the speaker system, the switch 402 symbolically represents all combinations of internal and external electrical connections. As can be seen, any signal can be electrically connected to any other signal, though not all connections will result in a functioning design.

Typically, without regard for any particular physical arrangement, one functioning design electrically connects PWR to PWRIN; VDC to VCC, VLED and every instance of VCC; GND to GLED and every instance of VSS; VOUT to SPKR; DOUT to DIN; and AOUT to VIN.

The same design with the lamp adapter 120 removed operates since the battery 412 provides power for any elements needing it (for example, those with VCC and VSS terminals).

If the physical arrangement is considered, the electrical connections remain the same, but may include pass-through connections labeled as PT1, PT2, PT3, PT4, PT5, and PT6. Depending on the physical arrangement—that is which modules comprise which elements—there may be additional pass-through connections for a particular module in addition to those illustrated and described herein, or there may be a fewer number of pass-through connections (or none at all) than those illustrated and described herein.

Figure 5:
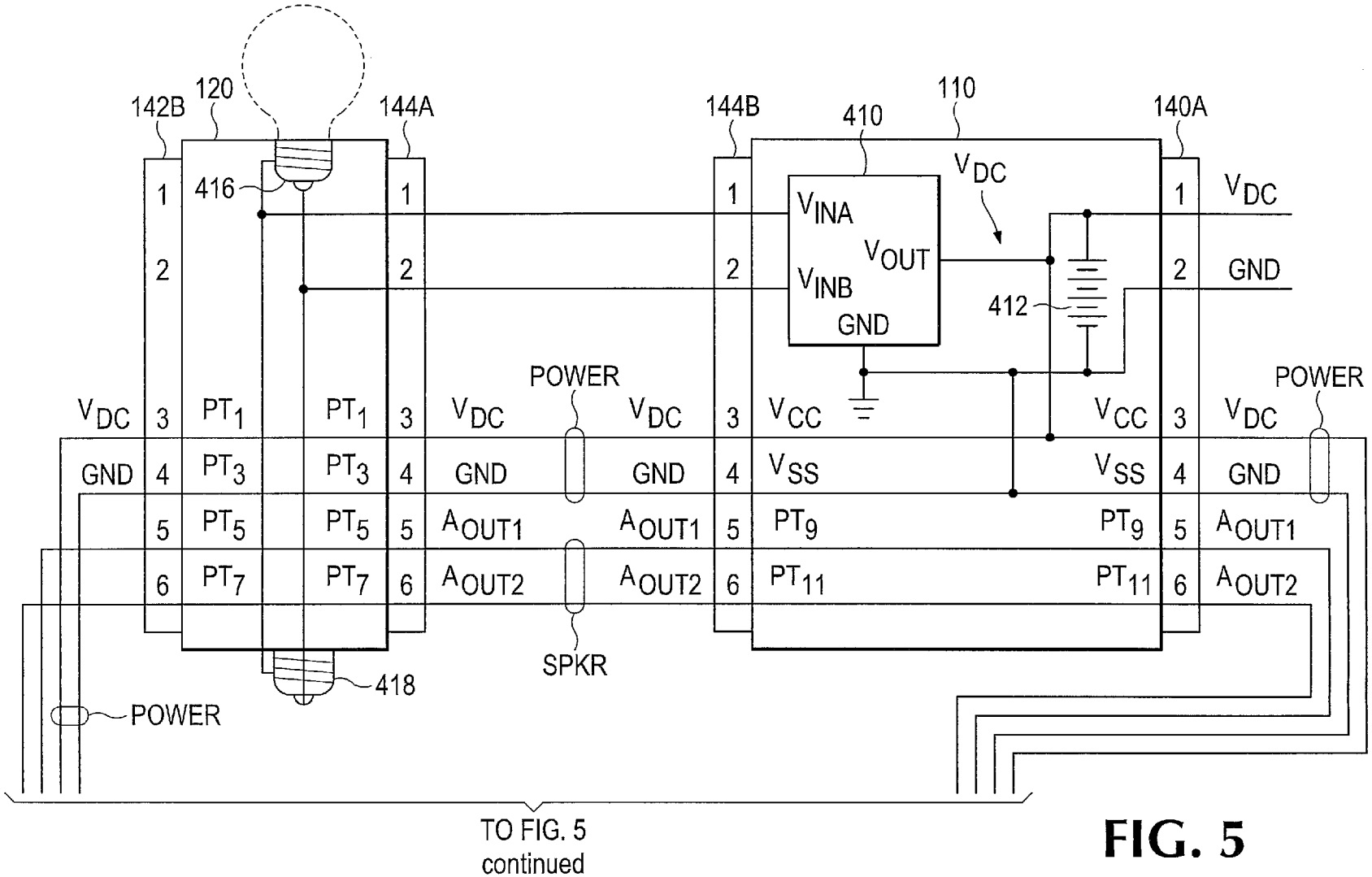
FIG. 5 is a schematic diagram of the speaker system illustrated in FIGS. 1 and 4.
Figure 5:
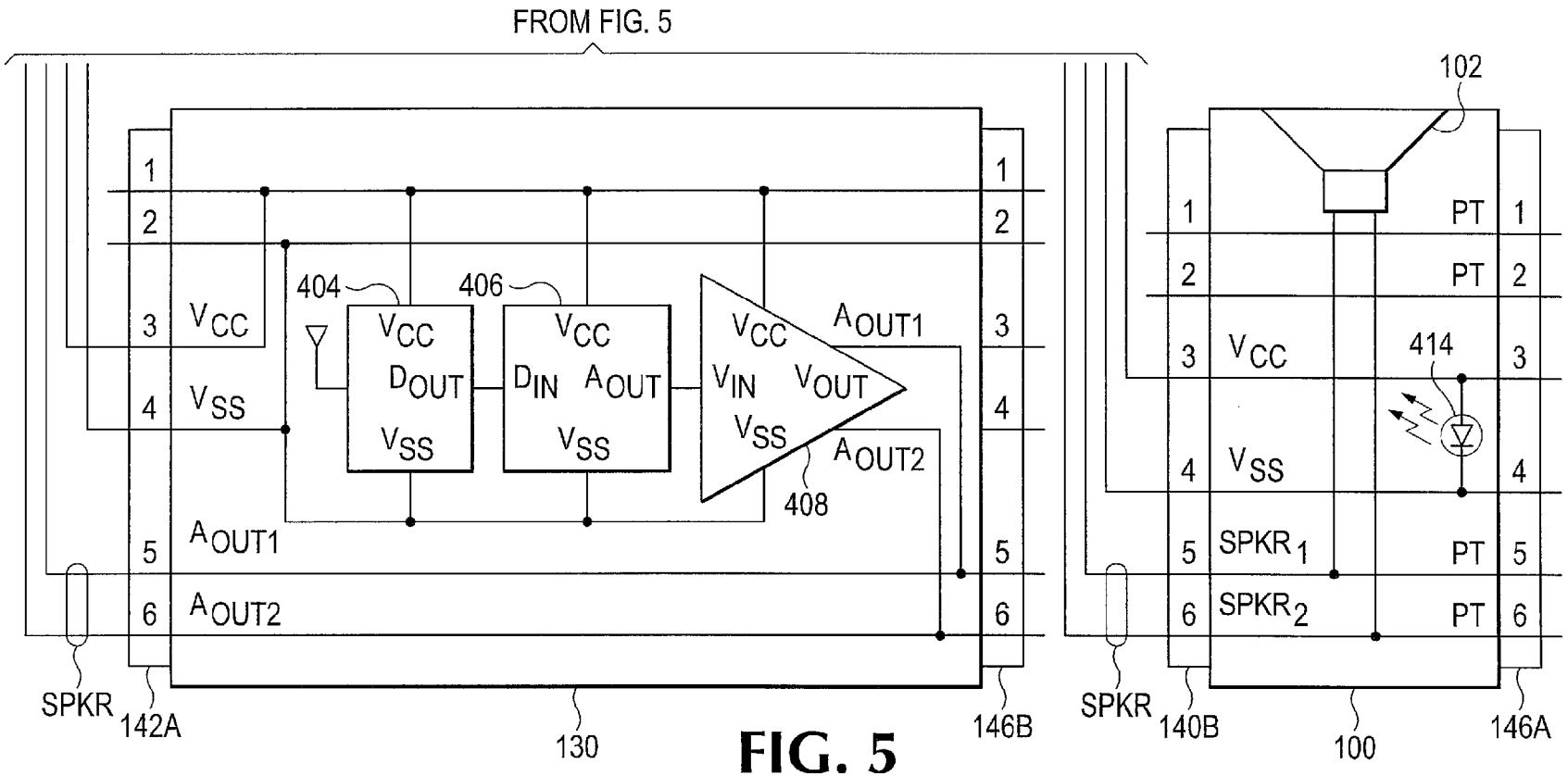

By way of example, FIG. 5 is a schematic diagram of the speaker system configured as illustrated in FIGS. 1 and 2 and comprising the elements shown and described with reference to FIG. 4 and the mount shown and described with reference to FIG. 3.

As already disclosed with reference to FIGS. 3A-3D, each instance of the mount in FIG. 5 comprises a first half and a second half. Each instance of the first half (140A, 142A, 144A, 146A) comprises electrical contact labeled 1, 2, 3, 4, 5, 6 in FIG. 5. Each instance of the second half (140B, 142B, 144B, 146B) have electrical contacts 1, 2, 3, 4, 5, 6 that correspond with those of the first half. The electrical contacts of the first half align with the electrical contacts of the second half when the first half and second half are connected to each other. Any instance of a first half can be connected to any instance of a second half.

Turning to FIG. 2, a first module 100 is connected to a second module 110 which is connected to a lamp adapter 120 which is connected to third module 130. The first module 100 comprises a speaker enclosure 101 having a first end 200, a second end 202, and intermediate section 204 connecting the first end 200 to the second end 202. The enclosure has an interior surface that defines the interior of the speaker enclosure, and an exterior surface. The first end 200 comprises an opening to which an outwardly facing driver 102 is attached.

An insulator 106 is attached to the exterior surface of the speaker enclosure 101. The insulator may be attached with a mechanical fastener, glue, epoxy, and the like. A first half of a first mount 104B is connected to the insulator, also by way of a mechanical fastener, glue, epoxy, or combinations thereof. Alternatively, the first half 104B may be directly connected to the enclosure 101 without an insulator. Two of the contacts (3, 4) of the first half of the first mount 140B are electrically coupled to the driver 102 (see FIG. 5 and more generally as represented by FIG. 4).

A second module 110 comprises a battery 412 which comprises an output (VDC and GND of FIG. 5 and more generally as represented by FIG. 4). A second enclosure 111 encloses the battery 412. An exemplary battery is a 5V lithium-ion battery or battery pack which includes a voltage regulator. A first half of a second mount 140A is connected to an exterior portion of the second enclosure 111. The second half of the second mount 144B is connected to another exterior portion of the second enclosure 111. In one example, the first and second halves are connected to approximately opposing areas of the exterior portion of the second enclosure.

Two of the electrical contacts 3, 4 of the first half 140A and the second half 144A of the second mount are electrically coupled to the battery output VDC, GND (see FIG. 5 and more generally as represented by FIG. 4). Two of the electrical contacts 5, 6 of the first half of the second mount 140A are electrically coupled to the corresponding electrical contacts 5, 6 of the second half of the mount 144B. Additionally, as will be disclosed in greater detail below, for additional flexibility in connecting the modules, two electrical contacts 1, 2 of the first half of the second mount 140A are electrically coupled to the output of the battery 412.

The second module 110 also comprises a power adapter 410 having an input and output. For example, the power adapter 410 may convert a 120 VAC input to a 5 VDC output. The power adapter 410 may also comprise a charging circuit for charging the battery 412.

The input of the power adapter 410 is electrically coupled to two electrical contacts 1, 2 of the second half of the second mount 144B. As already disclosed, the power adapter may be housed by a different module such as the lamp adapter, or it may be a separate module entirely (not shown) with inputs electrically coupled (by way of additional mounts) to the lamp adapter and outputs electrically coupled to the battery 412 of the second module 110.

A third module comprises a third enclosure enclosing electronics. The electronics includes an audio receiver 404, an audio amplifier 408. The audio receiver comprises a wireless transceiver 404 and an audio decoder 406. The audio amplifier comprises comprises an input, an output. An input of the audio decoder is coupled to an output of the wireless transceiver, and an output of the audio decoder is coupled to the input of the audio amplifier. The wireless transceiver 404, audio amplifier 408, and audio decoder 406 each include a power supply input for powering each device. In another example, the audio receiver 404 comprises speaker terminals which are electrically connected to the audio amplifier 408.

The power supply may be, for example, and device that provides a power output comprising a generally fixed, predictable, or regulated voltage and/or current. One example of a power supply is a battery. Another example of a power supply is a power regulator (this is sometimes referred to as a power adapter by users), which receives as input a power source (such as 120 VAC, 220 VAC, regulated or unregulated DC power) and outputs a generally fixed voltage and/or current. The power supply may be electrically coupled to at least some of the electronic elements, thereby powering them. In one example, the power supply is connected to the battery, thereby charging the battery.

Wirelessly receiving audio, processing or decoding audio, and audio amplifiers are well understood by those having ordinary skill in the art. Briefly, and without limitation, data representative of an audio signal is transmitted from a server over a wireless network such as according to any of the following protocols, alone and in combination: IEEE 801.11, IEEE 802.15, HTTP, RTP, MMS, RTSP, and the like. The audio signal may be compressed in a lossy format such as but not limited to mp3 or AAC, compressed in a lossless format such as but not limited to FLAC, or uncompressed. Lossy compression and lossless compression are well understood by those having ordinary skill in the art. The encoded audio is received by the wireless transceiver 404 and decoded by the audio decoder 406 which includes a Digital-to-Audio Converter (DAC) and outputs an analog signal representing the audio. The analog signal is amplified by the amplifier 408 which amplifies the audio signal to a level suitable to drive a driver. It is noted that the audio may be transmitted analogly, that is not via a packetized digital wireless network.

Turning back to FIG. 5, a third mount comprises a first half 142A connected to an exterior portion of the third enclosure (131 of FIG. 2). Two electrical contacts 5,6 of the first half of the third mount 142A are electrically coupled to the outputs AOUT1, AOUT2 of the audio amplifier 408. Two electrical contacts 3,4 of the first half of the third mount 142A are electrically coupled to the power supply inputs and ground of the wireless transceiver 404, audio decoder 406, and audio amplifier 408.

Configured as disclosed in the preceding paragraphs, when the first module 100, second module 110, and third module 130 are connected—with or without the lamp adapter 120—the driver 102 is electrically coupled to the output of the audio amplifier 408, and the battery is electrically coupled to the power inputs of the transceiver 404, amplifier 408, and decoder 406.

The lamp adapter 120 comprises a first end comprising a first connector 418 that can be connected to a power source that powers a light fixture, and a second end comprising a second connector 416 that can be connected to the lamp 20 of a light fixture. In one example, the first end 418 of the lamp adapter screws into the socket of a light fixture and the second end 418 accepts a light bulb. In another example, the first 416 end mates with the track of a track lighting system and the second end 418 accepts the track light and/or bulb.

A first half of a fourth mount 144A is connected to an exterior portion of the lamp adapter 120, and a second half of the fourth mount 142B is connected to another, for example, opposing portion of the lamp adapter.

Configured as disclosed in the preceding paragraphs, when the first module 100, second module 110, third module 130, and lamp adapter 120 are connected, the driver 102 is electrically coupled to the output of the audio amplifier 408, and the battery is electrically coupled to the power inputs of the transceiver 404, amplifier 408, and decoder 406, and the input of the power adapter 410 is electrically coupled to the first end of the lamp adapter which supplies power.

As already disclosed, the power adapter 410 may be included in the lamp adapter 120 rather than with the battery 412 of the second module 110. In this case, the output of the voltage regulator is electrically coupled electrical contacts 1, 2, 3, 4 of the first and second halves of the fourth mount 144A, 142B. In any case, the output of the power adapter 410 is electrically coupled to the battery 412.

So, as described above with reference to FIGS. 1, 2, and 5 (and more generally as symbolically illustrated in FIG. 4), first half of mount 142A is connected to second half of mount 142B, first half of mount 144A is connected to second half of mount 144B, first half of mount 140A is connected to second half of mount 140B. As shown in FIG. 1, this connects module 130 to module 120 to module 110 to module 100. With the lamp adapter 120 connected to the prior art light fixture 10, the speaker system is referred to as plugged-in and charging since the speaker system is connected to an external power source and the battery is being charged. This configuration is represented as follows:

Configuration 1—Plugged-In/Charging

142A-142B, 144A-144B, 140A-140B (130 to 120 to 110 to 100)

As described above, any first half of a mount can be attached to any second half of a mount. Given the arrangement of elements 102, 404, 406, 408, 410, 412, 414, 416, 418 with respect to the modules 100, 110, 120, and 130, and having the electrical connections to contacts labeled 1, 2, 3, 4, 5, 6 of each first half of each mount 140A, 142A, 144A, 146A and each second half of each mount 140B, 142B, 144B, 146B, many other configurations are possible without sacrificing any of the features and advantages of the speaker system. Recall, as disclosed above, the lamp adapter 120 is not required; if the battery 412 is charged the speaker system can operate in a completely wireless configuration off of battery power. Some alternate configurations with this design are:

Configuration 2—Plugged-In/Charging

146B-146A, 140B-140A, 14B to 144A (130 to 100 to 110 to 120)

Configuration 3—Wireless/Battery Operation

142A-144B, 140A-140B (130 to 110 to 100)

Configuration 4—Wireless/Battery Operation

146B-140A, 142A-140B (130 to 110, 130 to 100)

Configuration 5—Wireless/Battery Operation

146B-146A, 140B-140A (130 to 100 to 110)

This is just one example and many others are possible. With knowledge of this disclosure and with specific reference to the more generalized design symbolically represented in FIG. 4, it is a matter of logic (which someone skilled in the art would have) and time to work through every combination of modules, elements included in the the modules, internal connections between the elements of each module, and external connections to each contact of each first half and each second half of each mount connected to each module. And, for each functioning combination (for example, any combination that results in the amplifier output floating would not be considered a functioning combination), it is also a matter of logic to find every configuration of module connections available, as detailed above.

Accordingly, some of the variables in designing the speaker system include, but are not limited to:

1) The number of modules;
2) The number of enclosures;
3) The number of mounts, i.e. the number of first halves the number of second halves;
4) Assuming all of the first halves of the mount are all identical, and the all of the second halves are identical, and that each contact of a first half has a corresponding contact in the second half, the number of contacts per mount half;
5) A listing of which elements are required (discussed above); and
6) A listing of elements that are not required (for example, the first module may include additional drivers, such as an active driver or passive radiator (also referred to herein as a "passive driver"), which may be considered optional depending on the desired speaker system).

In this way, all possible designs can be represented in one or more (potentially large) truth tables. Accordingly, those skilled in the art will now appreciate that any operations, optimizations, and other methods that those skilled in the art would use with or apply when working with truth tables, can be equivalently implemented to realize any design possible, in light of the present disclosure.

It is noted that while some elements are shown as separate components, the present disclosure should be understood to include elements that are combined. For example, battery packs that include a battery 412 and a power adapter (equivalently referred to as a power converter or regulator) 410 that both charges the battery and regulates the output voltage of the battery are commercially available. Also, the transceiver 404, decoder 406, and amplifier 408 are commercially available as a single integrated circuit.

Additionally, while the figures show the Plugged-In/Charging configuration being power by a conventional floor or table lamp, it should not be assumed that a lamp, more generally referred to herein as a "light fixture" is required, that the power supplied to the speaker system to charge the battery must be 120 VAC, and the like. In fact, power can be supplied from any source.

In one example the lamp adapter 120 is compatible with a track lighting system and the speaker system hangs from the track. Since many track lighting systems include a transformer and other circuitry to provide a lower voltage to the lamps of the track lighting, the power adapter 410 should be chosen and designed accordingly. In some cases, the power adapter may not be necessary if the track lighting voltage is compatible the battery pack 412.

In another example the lamp adapter is a mount that mounts one or more of the modules to a wall in the style of a sconce. In this sconce example, the lamp adapter may further have a first half permanently mounted to the wall, and a second half permanently mounted to one of the modules. In this way, the sconce can be removed from the wall and the speaker system operated in a wireless/battery-powered configuration when desired. In yet another example, the lamp adapter comprises a ceiling mount. and one or more of the modules hang from the ceiling. For example the ceiling mount may comprise a light fixture configured to be connected to the ceiling (or other overhead structure), such as a track light fixture. It is understood that when reference is made to "connected to the ceiling" or "suspended" from the ceiling, that this includes direct or indirect connections. For example, a direct connection may be a fixed connection directly to a fixed ceiling-mounted light fixture, and an indirect connection may be via a ceiling mounted light fixture such as a track-light fixture and its associated components. Therefore, the phrase and phrases similar to, "a light fixture configured to be connected to a ceiling" is understood to mean, in light of the present application, any type of system or apparatus known in the art for mounting lamps to a ceiling.

Figure 6:
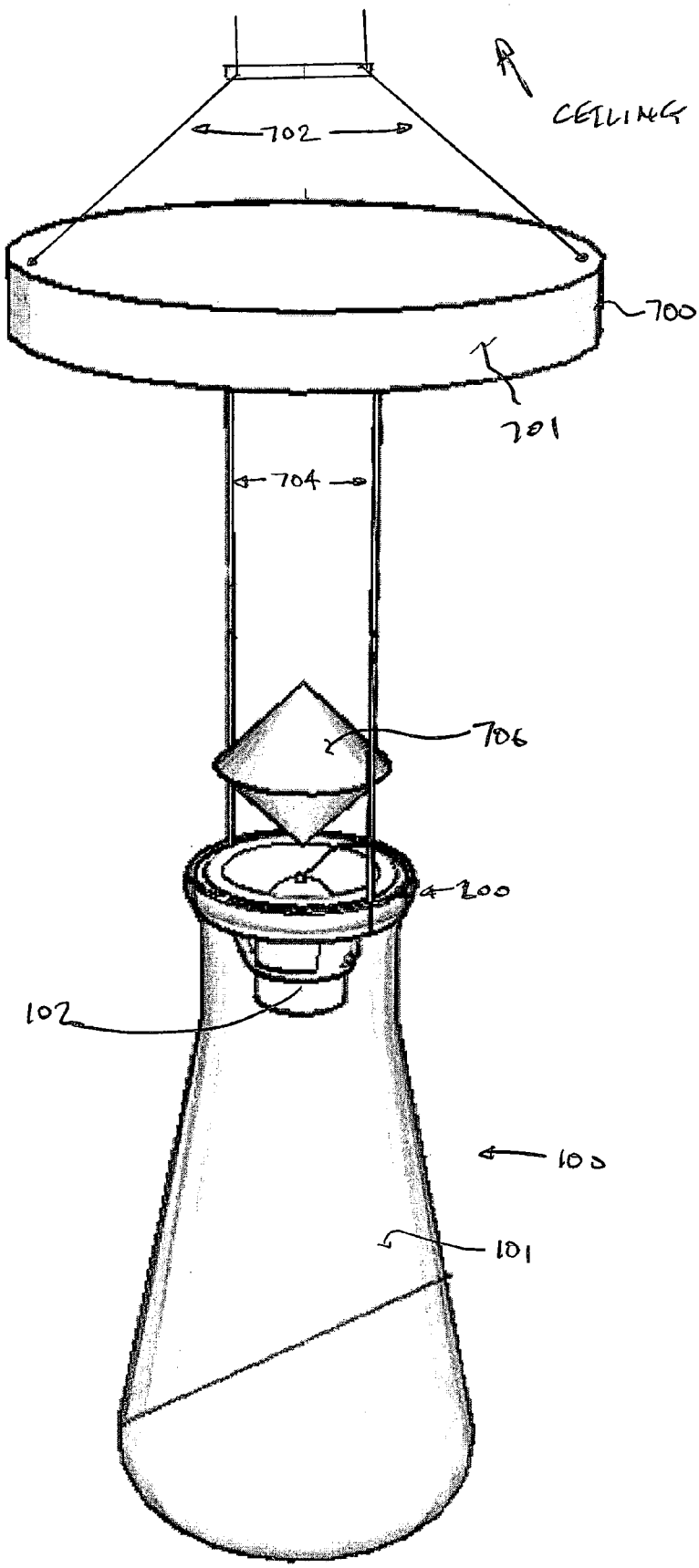
FIG. 6 shows a vertically mounted speaker system including a diffuser.

FIG. 6 shows an exemplary ceiling mount configuration. The speaker system is suspended from wires 702 which are connected to a first module 700. The fist module 700 comprises an enclosure 701 which encloses the electronics which includes elements such as the transceiver 404, the decoder 406, the amplifier 408, and if needed, the power adapter 410, and battery 412. Power is supplied to the electronics via wires 702.

A second enclosure 100 comprises a speaker enclosure 101 and a driver 102 that is attached to an opening at the first end 200 of the speaker enclosure so that the driver faces upwards towards the ceiling. The second enclosure is suspended from the first enclosure 701 by wires 704. Wires 704 are conductors that electrically connect the output of the amplifier 408 enclosed by the first enclosure 701 to the driver 102.

The wires and their connections to their corresponding modules can be considered equivalent to the mounts disclosed earlier since they function to support and/or connect the modules, and they electrically connect the various elements and modules. Furthermore, while the mounts were previously disclosed as being non-permanent or removeably connected in that the halves can be separated and reattached, this is not a requirement and some or all of the mounts (whether they comprise wires, hot mounts, or any other mount available to those skilled in the art) may be fixed and permanent so that they are not removable or interchangeable. For example, the first and second modules may be fixedly connected to each other by a permanent mount which may include any type of fastener, connector, adhesive, mechanical fastener, chemical, and the like, alone and in combination, known by those skilled in the art for connecting one item to another. Mounts may also comprise rods and other items commonly used to fasten, suspend, or otherwise mount light fixtures.

As mentioned previously, the upwardly directed driver causes the ceiling to function as a diffuser. In the same way, the enclosure 701 of the first module 700 also functions as a diffuser. Also, the upwardly directed driver causes higher frequencies to be directed upwards. And, if as disclosed below, the speaker enclosure comprises an opening, port, passive radiator or second driver at the second end of the enclosure, lower frequencies are directed downwards.

Additionally, FIG. 6 includes a diffuser 706 that is supported by wires 704. Diffuser 706 may be attached to wires 704 at grooves or holes in the diffuser 706 through which wires 704 pass. In this way, the diffuser 706 may be moved closer to or further away from the driver 102, in order to tune or adjust the sound of the speaker system. It is appreciated, that any of speaker systems shown, such as those not suspended from above (e.g. FIGS. 1, 2, 7, 8) may also comprise a diffuser positioned above the driver 102. For example, the diffuser may be attached to a portion of the driver or to the speaker enclosure. Additionally, the diffuser may be user removable or replaceable, thereby allowing a user to customize their speaker system and its performance.

The diffuser 706 may be of any shape and size and include any materials known by those skilled in the art as affecting or modifying sound waves. The same holds true for the first module 700. And, in the event the second module 100 comprising is mounted vertically so that the driver 102 is directed towards the ceiling and there are no modules or other elements located in between the driver 102 and the ceiling that would interfere with the path of sound waves emanating from the driver 102, then the ceiling can be considering equivalent to a diffuser. In this example, the audio can be tuned or otherwise adjusted by adjusting the distance between the speaker enclosure 101 and the ceiling.

Figure 10:
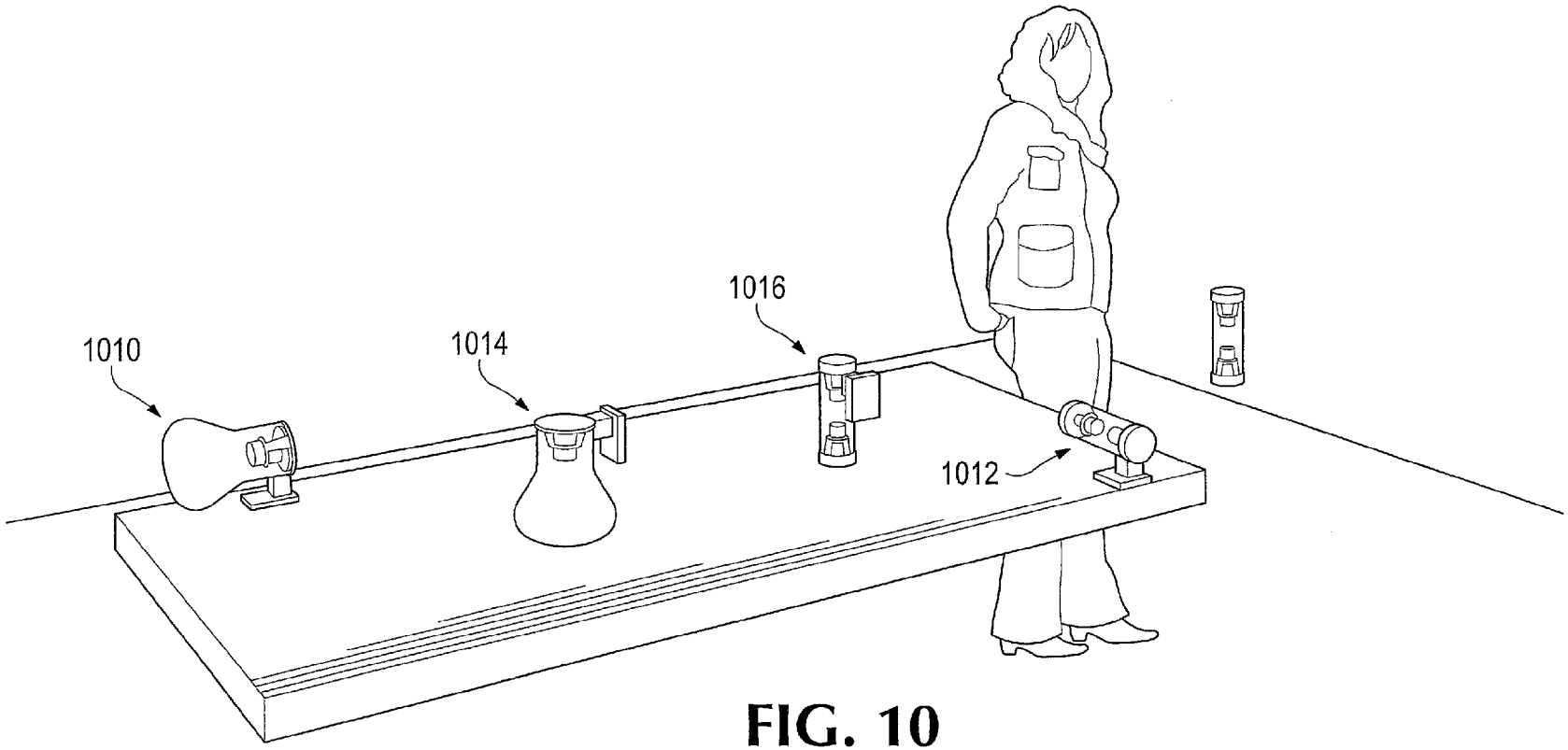
FIG. 10 illustrates various speaker system configurations.

While reference has been made thus far to the speaker enclosure and speaker being vertically mounted with the driver directed up, it understood that the speaker enclosure can be positioned or mounted at any angle (relative to normal of the ceiling) so that the driver is not directed directly up towards the ceiling. In one example. the speaker enclosure is horizontally mounted and the axis of the speaker lies approximately parallel with the ceiling (or perpendicular to the ceiling's normal). In another example, the speaker enclosure is mounted vertically but rotated 180 degrees from the speaker up position so that the speaker is directed down, toward the floor and away from the ceiling. In this configuration, the floor functions as a diffuser. By way of example, FIG. 10 shows just a few configurations, including configurations with a module base (1010, 1012) with the enclosures horizontally positioned on a table, and the same configurations with an enclosure base (1014, 1016) with the enclosures vertically positioned on the table.

Any of the modules may also comprise a power port, such as a USB port, that can be used to charge or power devices external to the speaker system. This port is electrically connected (either directly, or through the mounts) to the battery output or, if the battery output is regulated, to output of the regulator. Similarly, any of the modules may include a charging port (which may also serve the dual function of the power port) into which a power adapter, such as a USB charger, can be plugged in to charge the battery and provide power to any other of the electrical components requiring electricity.

Figure 7:
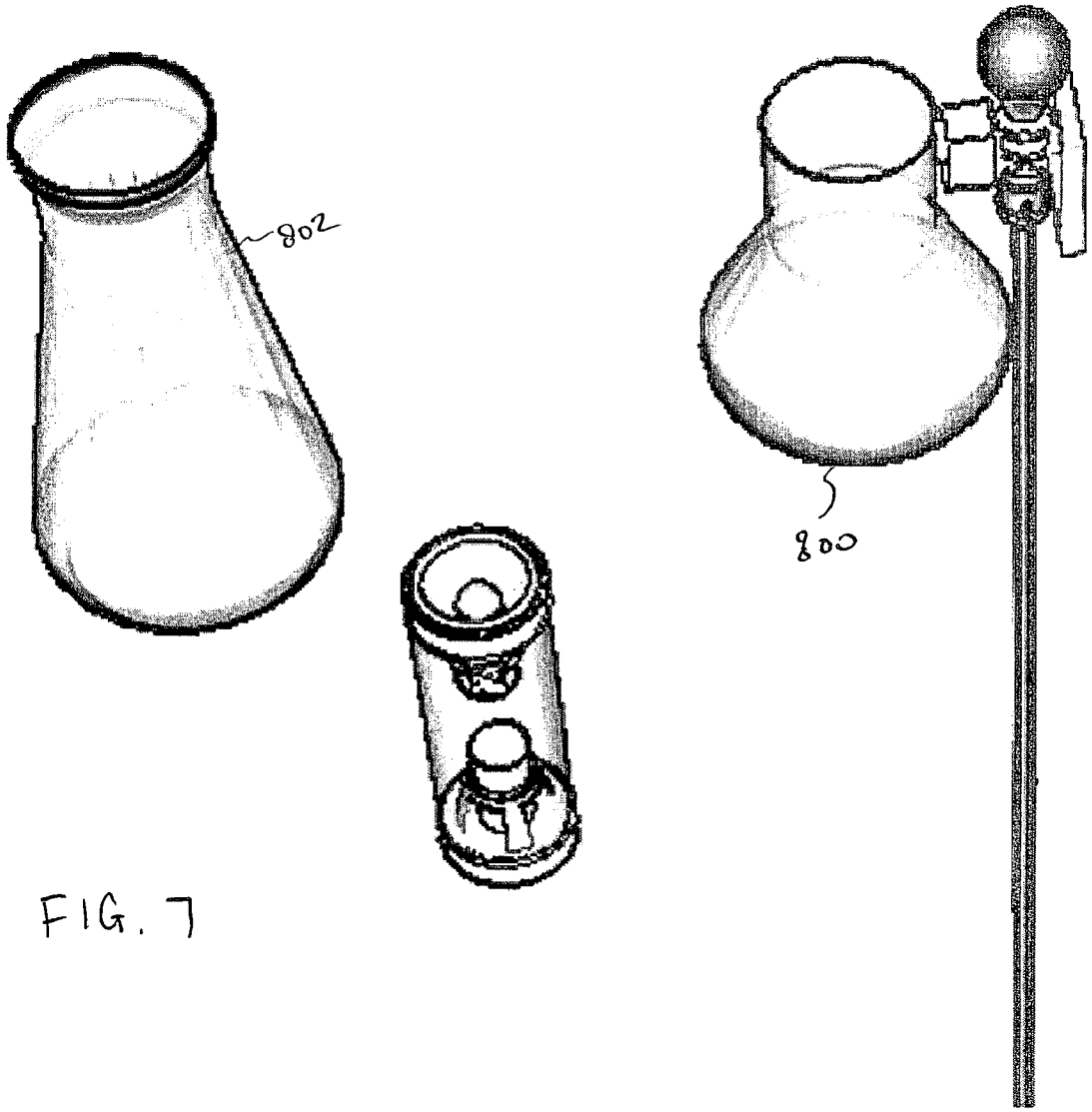
FIG. 7 is a perspective view of differently shaped speaker enclosures of the speaker system.
Figure 11:
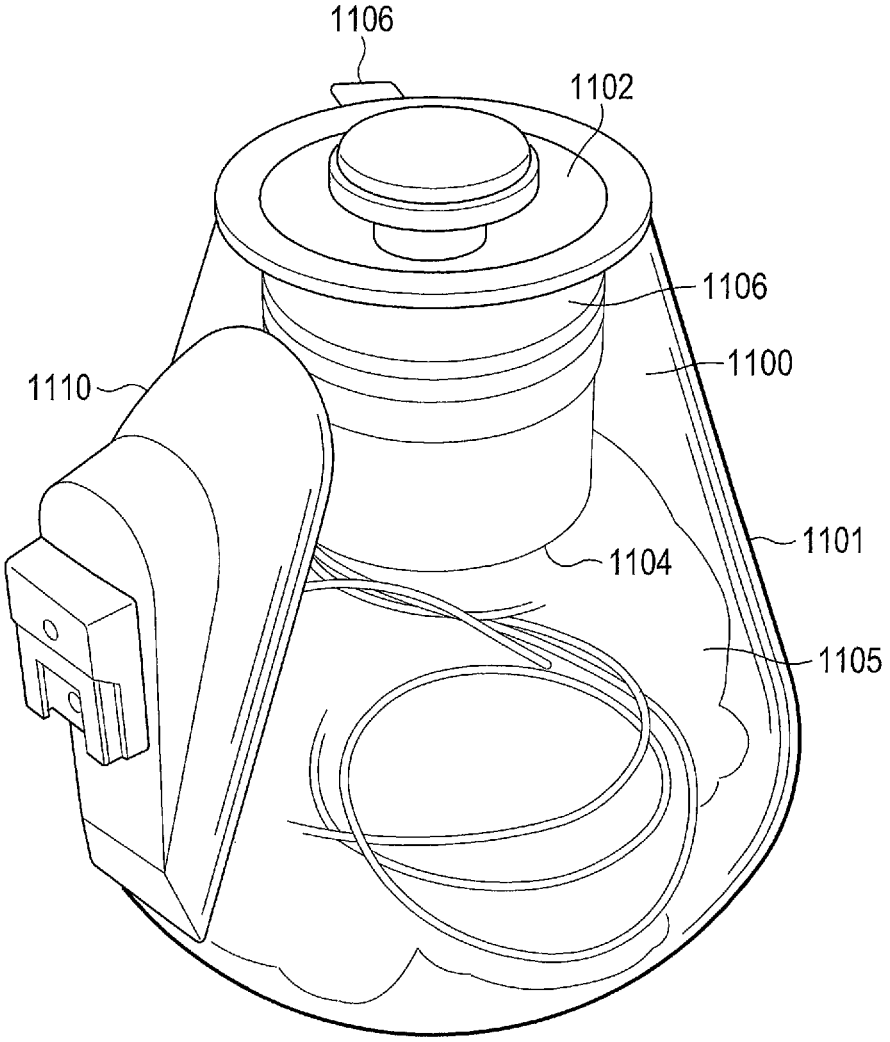
FIGS. 11-24 show various views of exemplary speaker systems.
Figure 12:
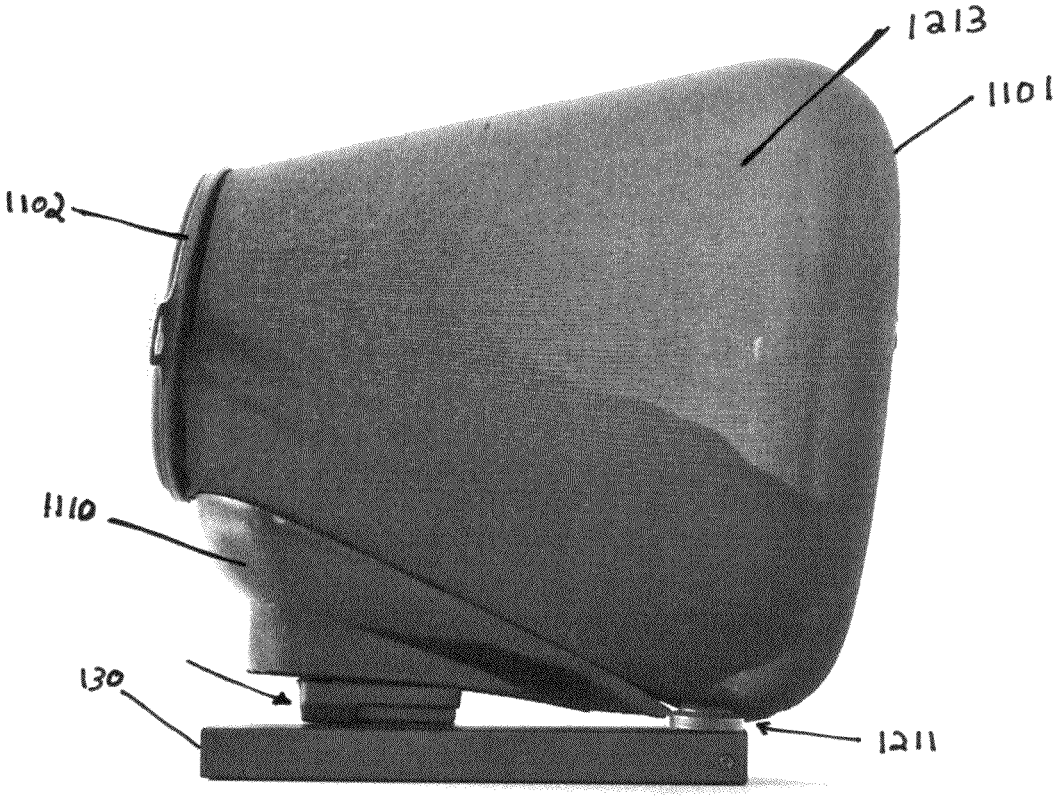
Figure 13:
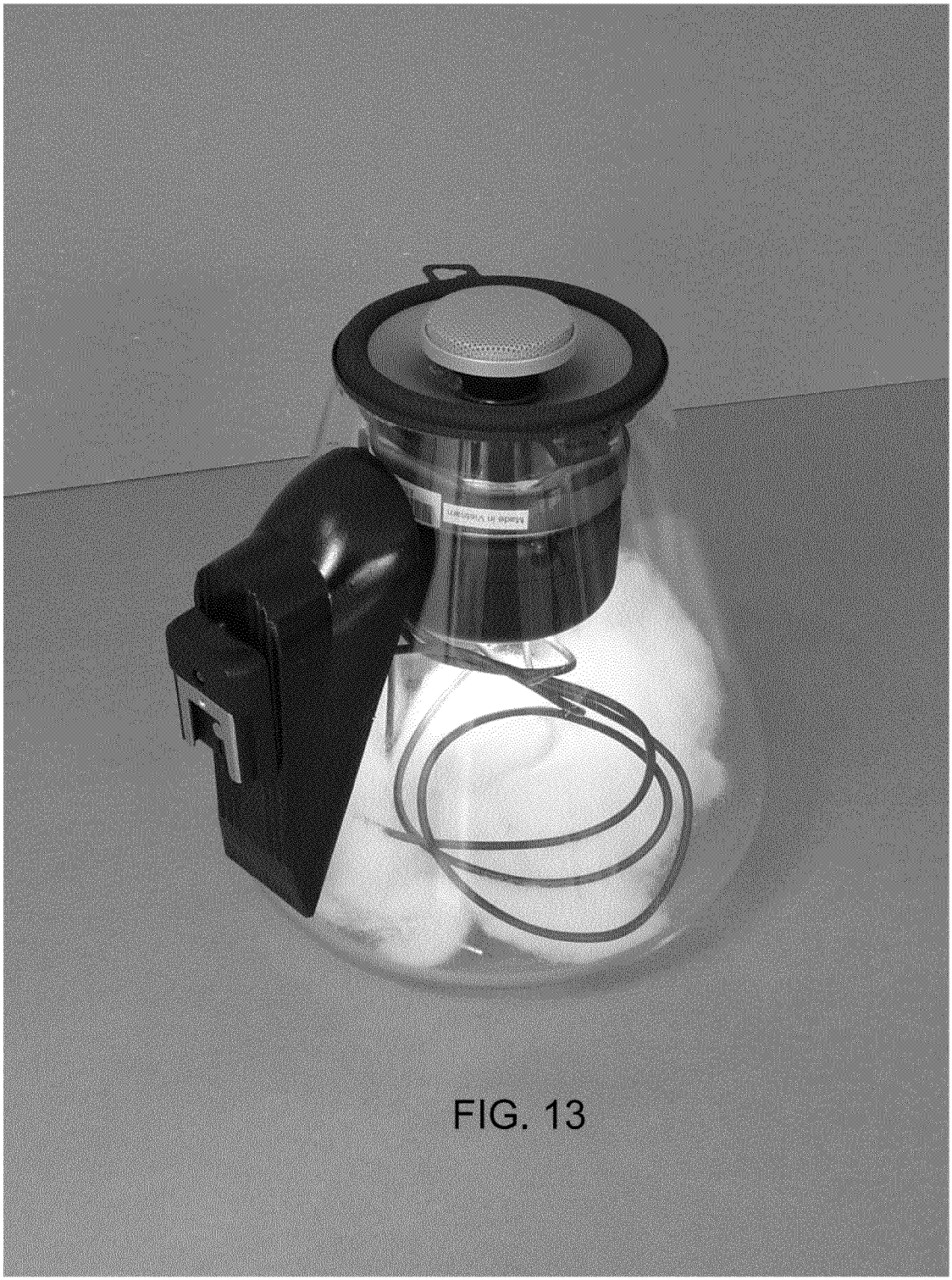
Figure 14:
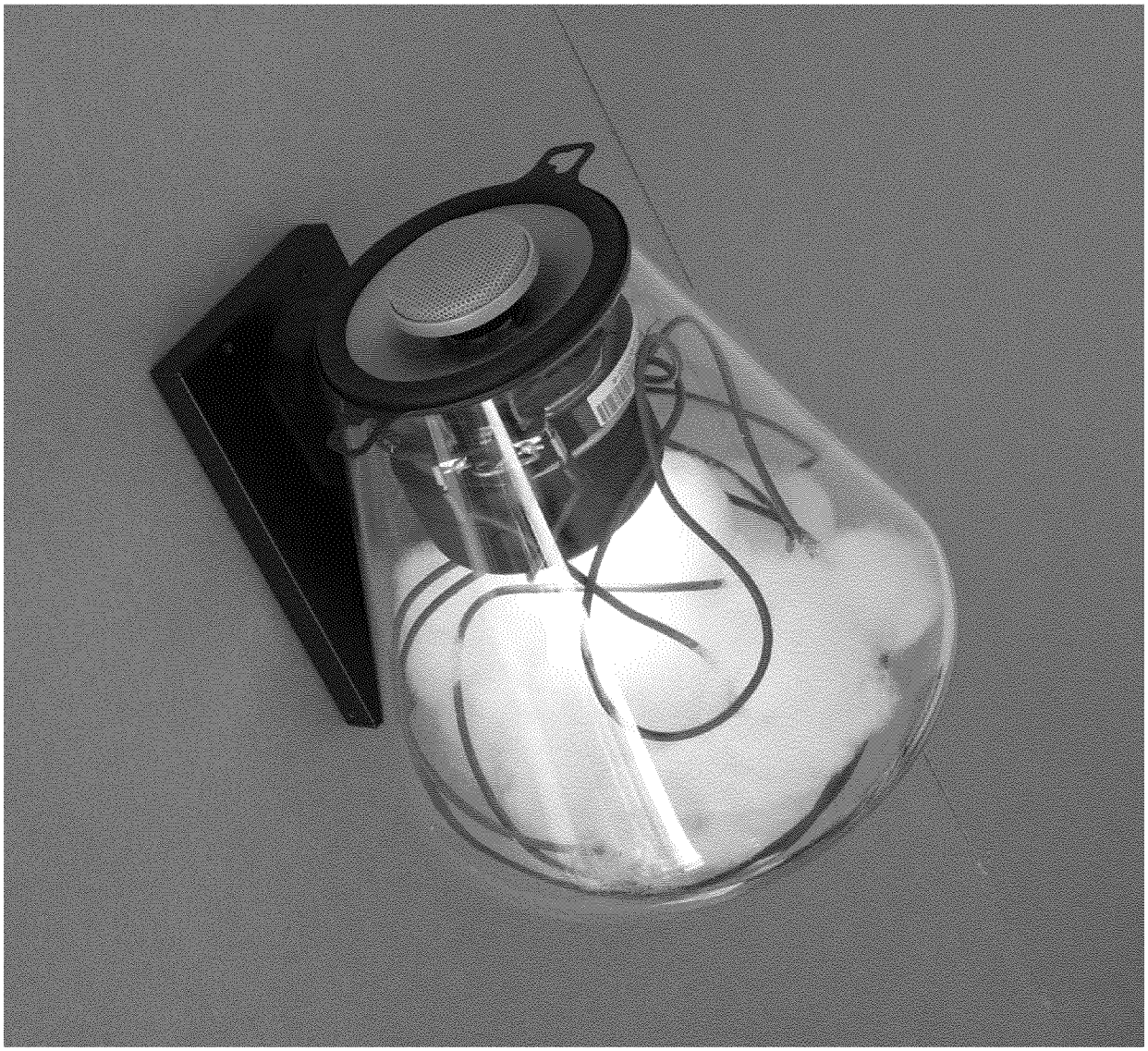
Figure 15:
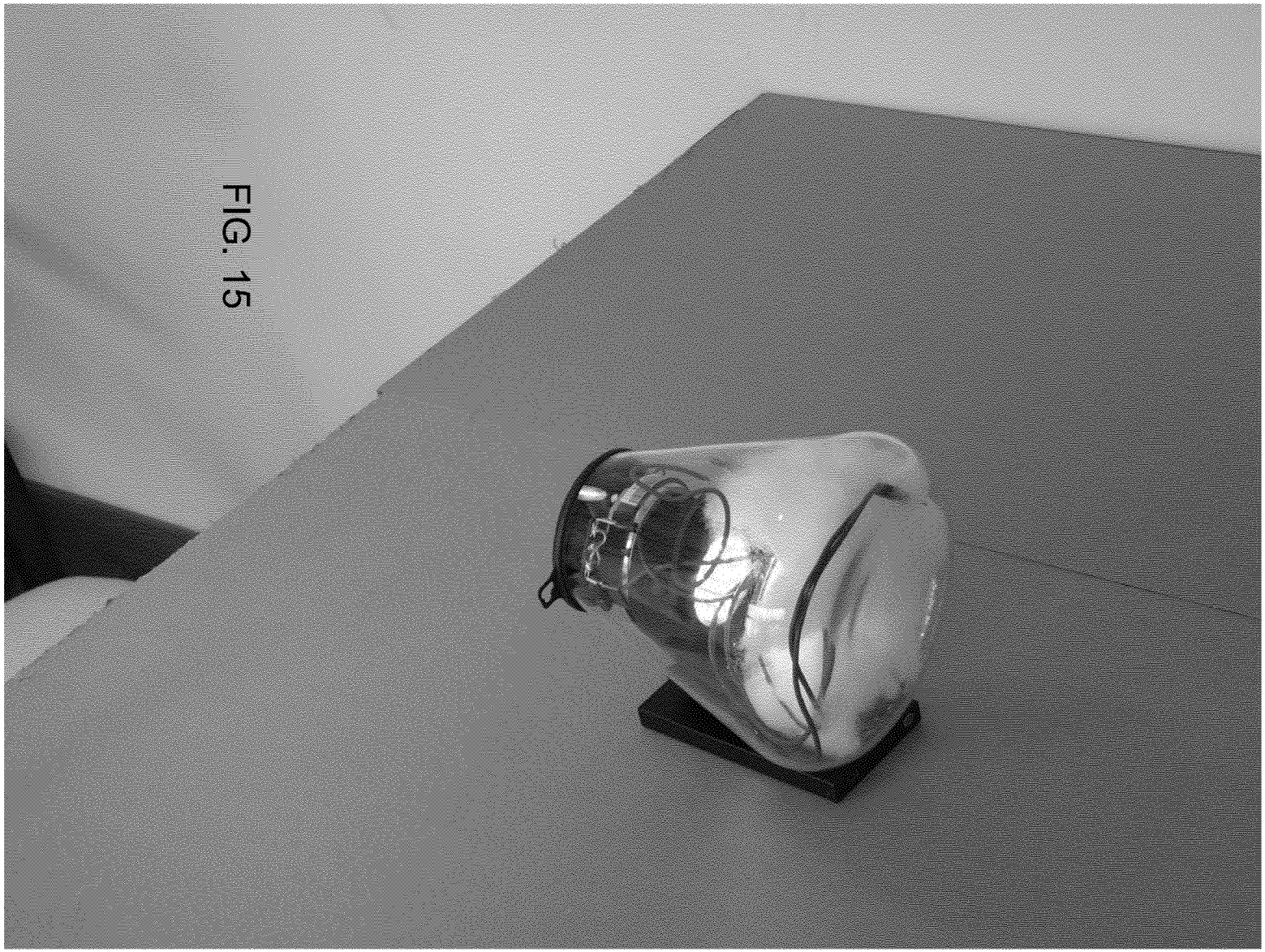
Figure 16:
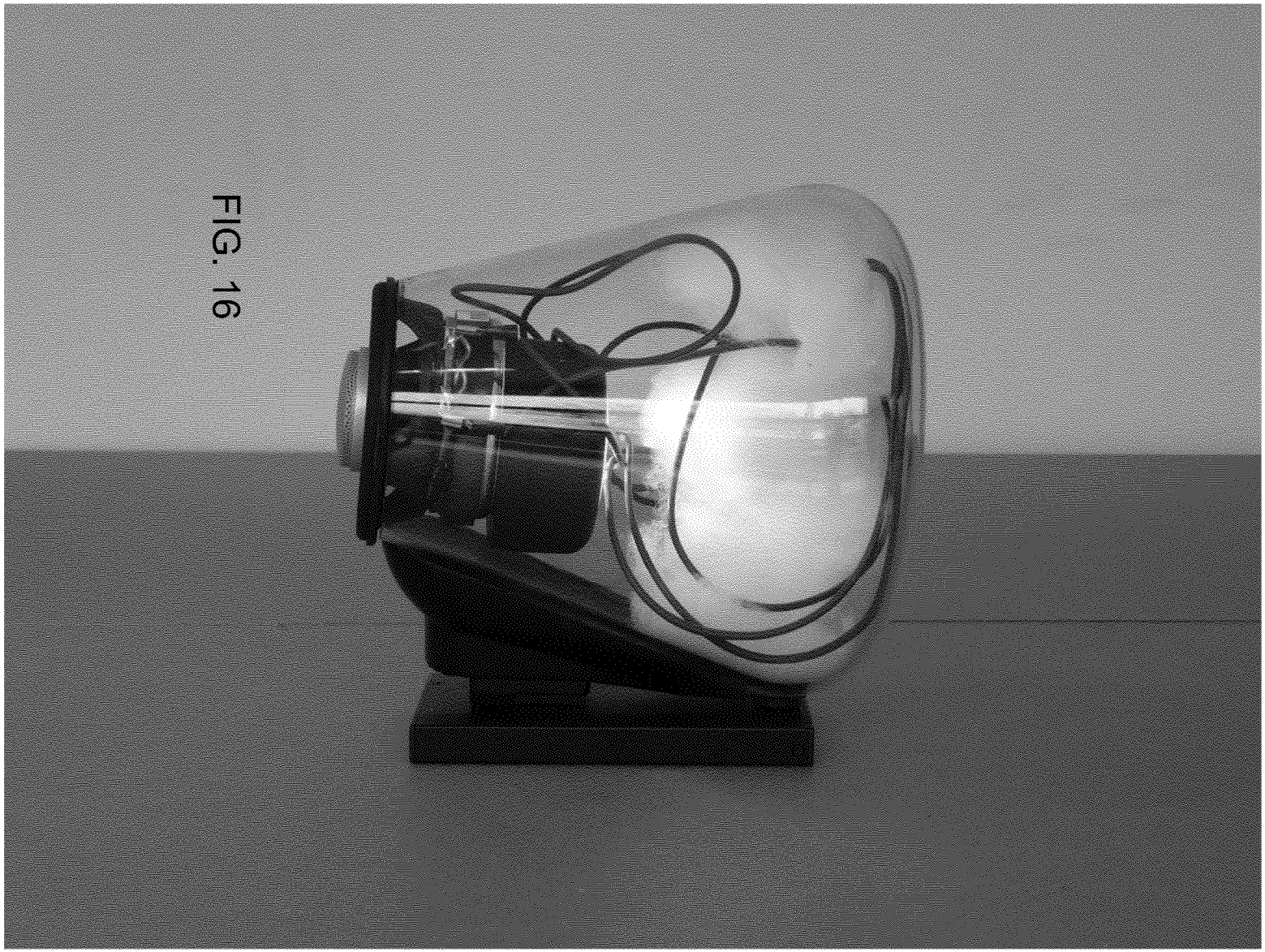
Figure 17:
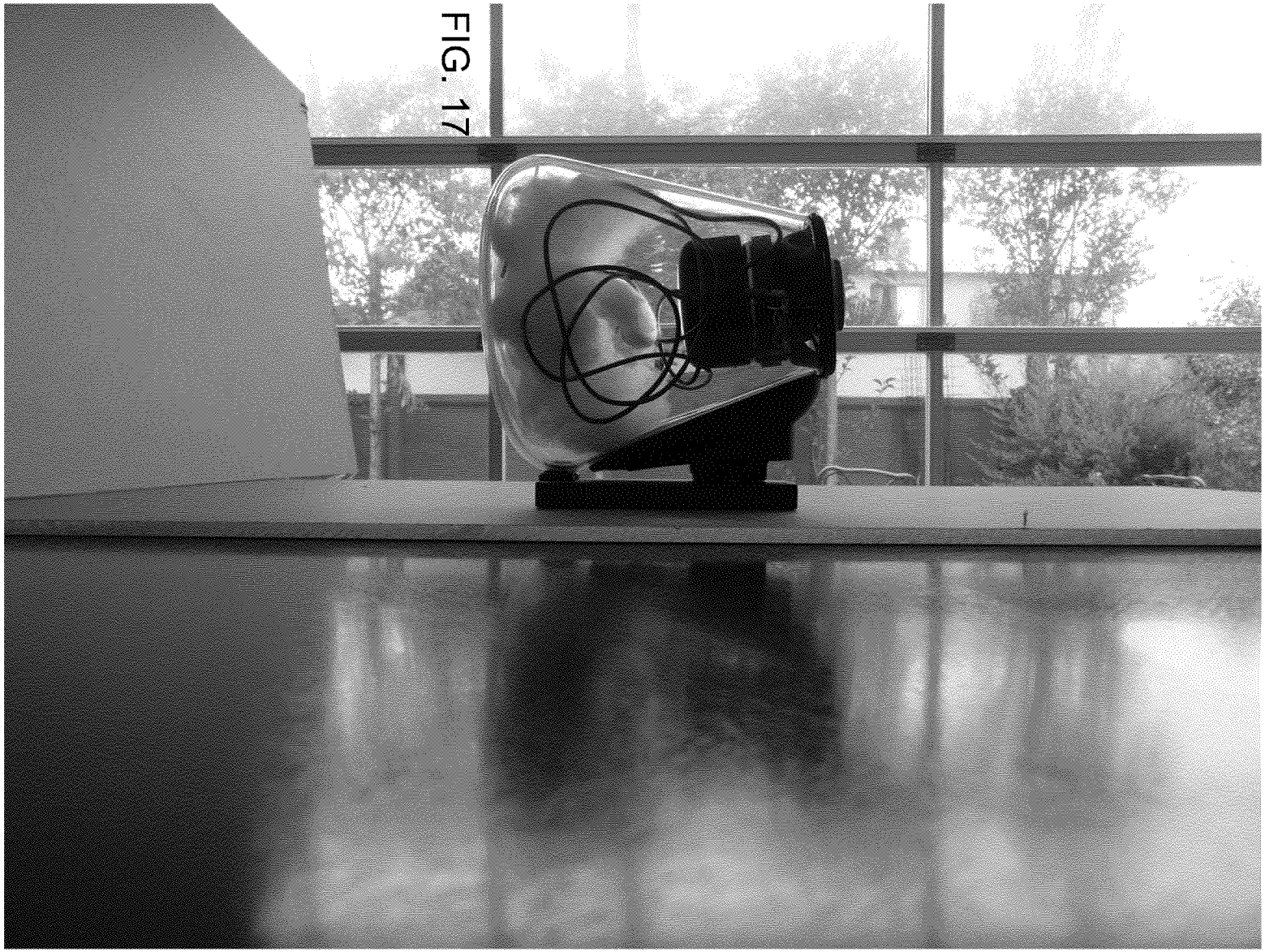
Figure 18:
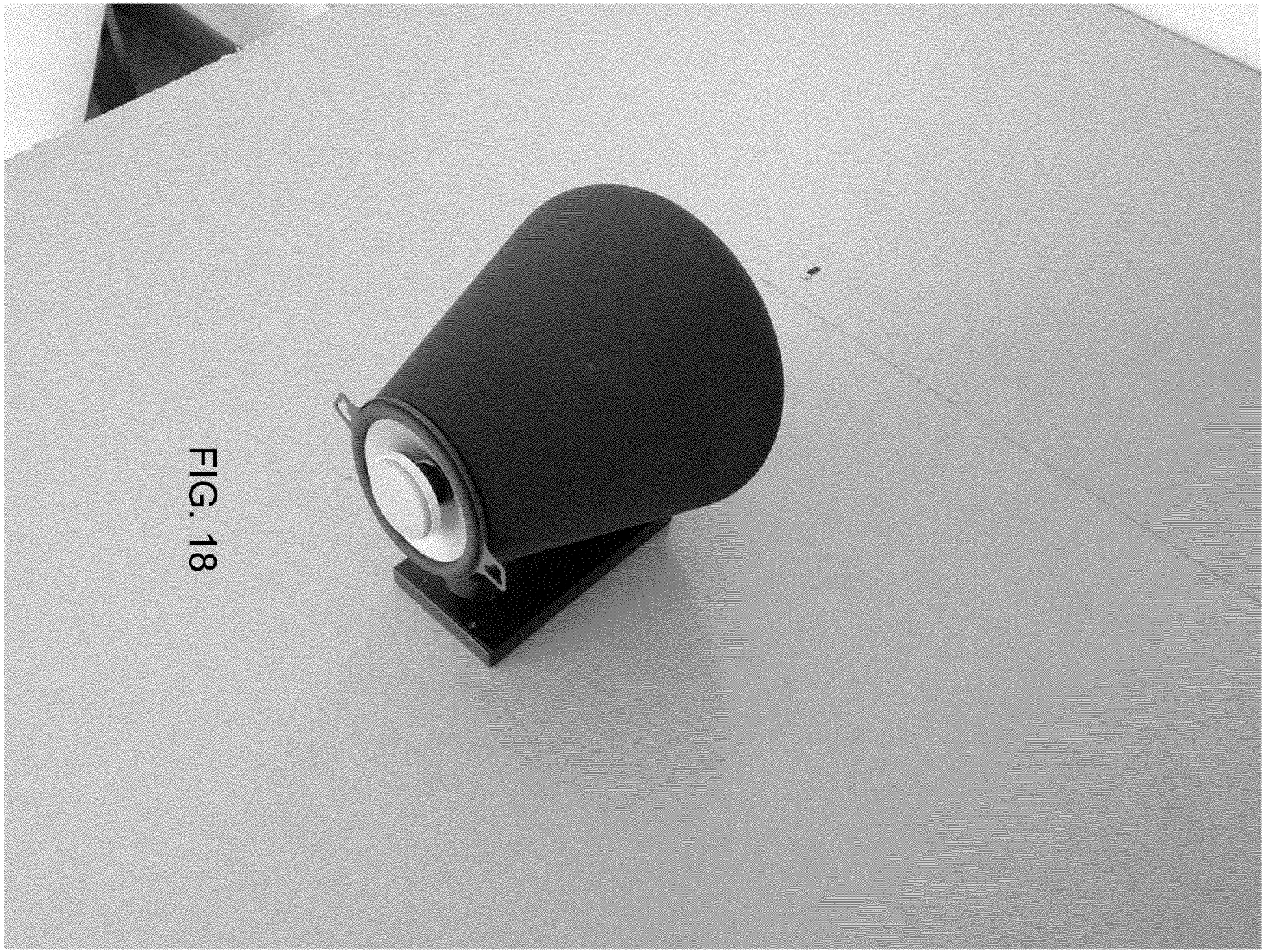
Figure 19:
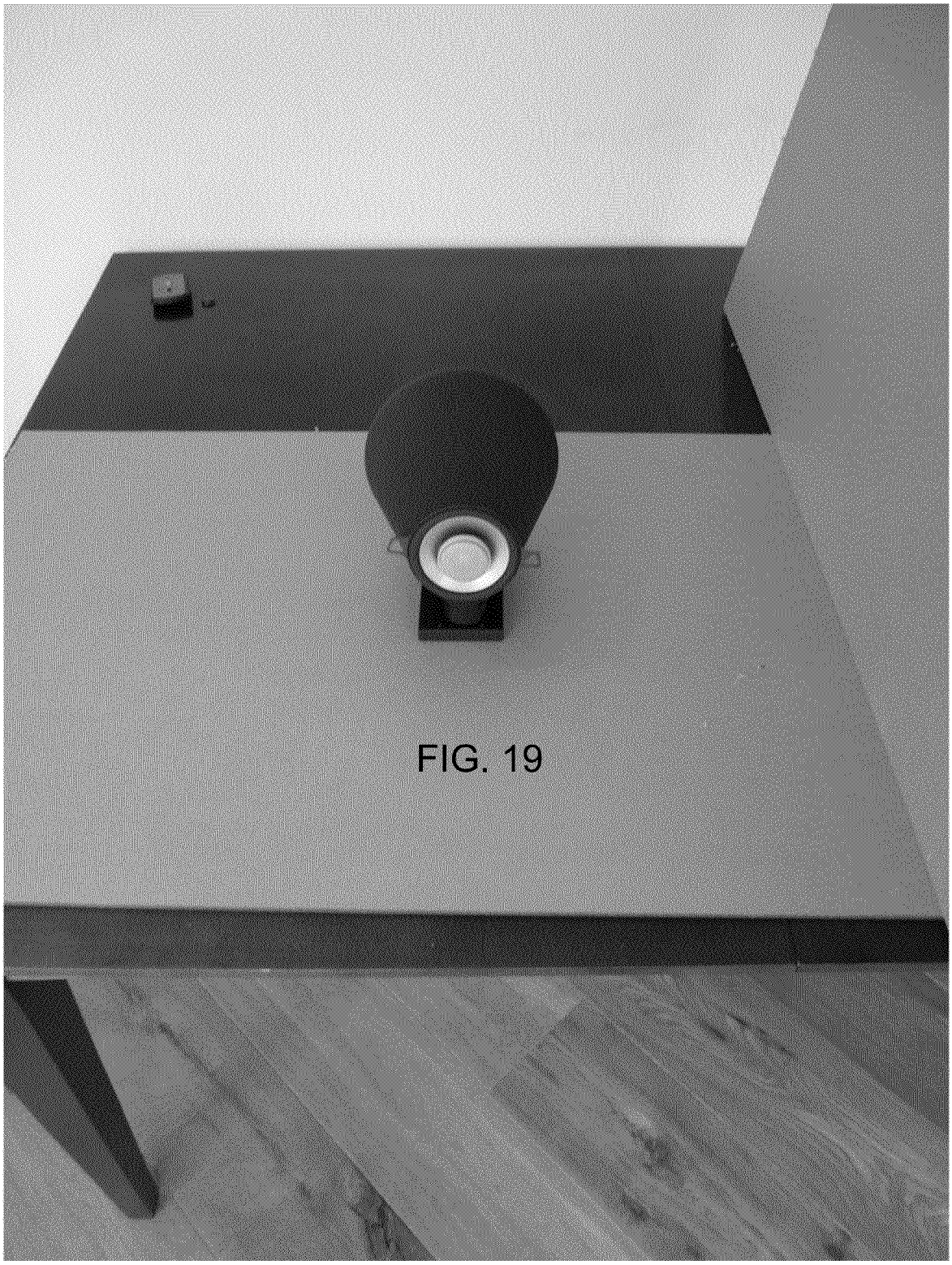
Figure 20:
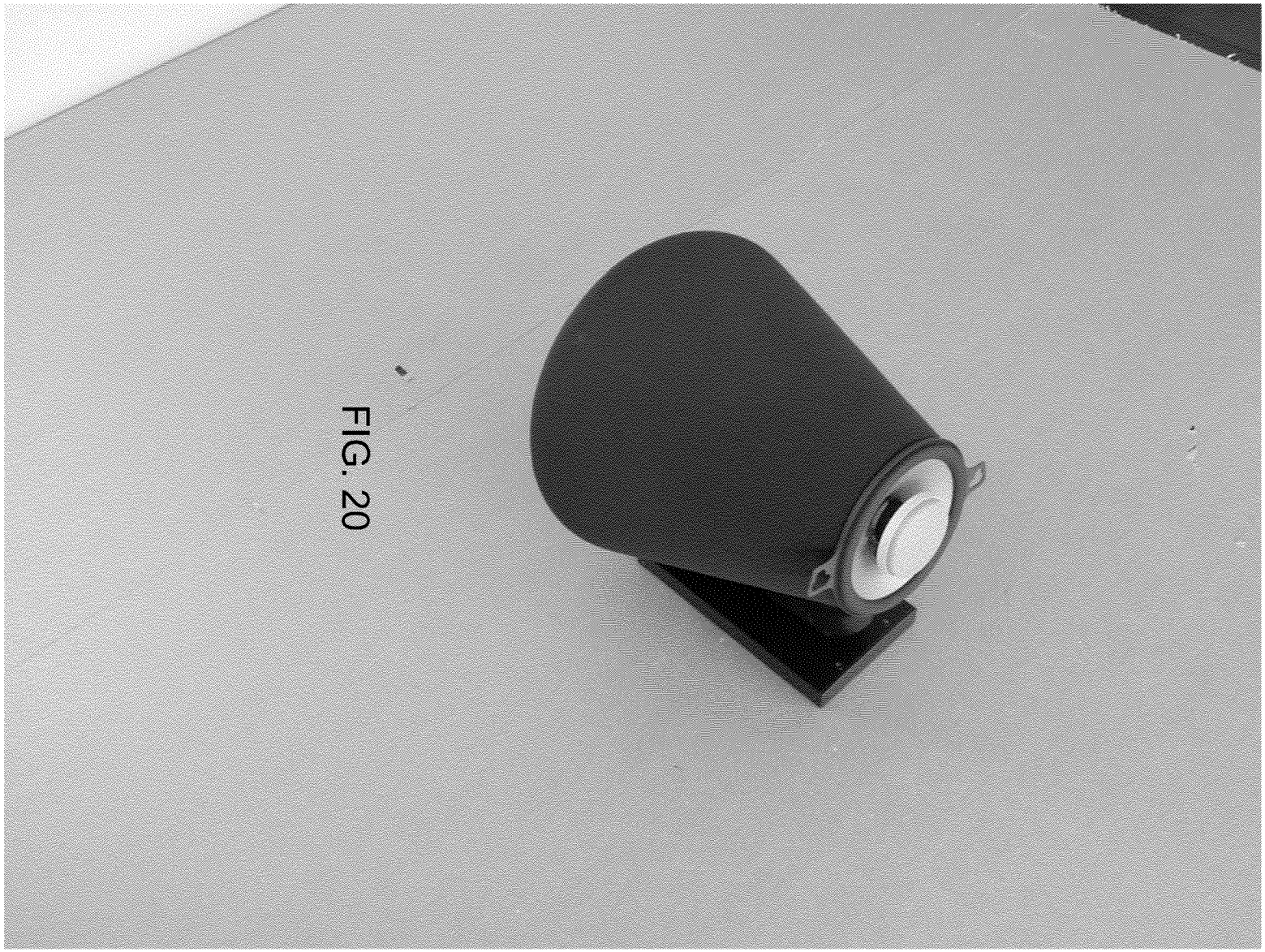
Figure 21:
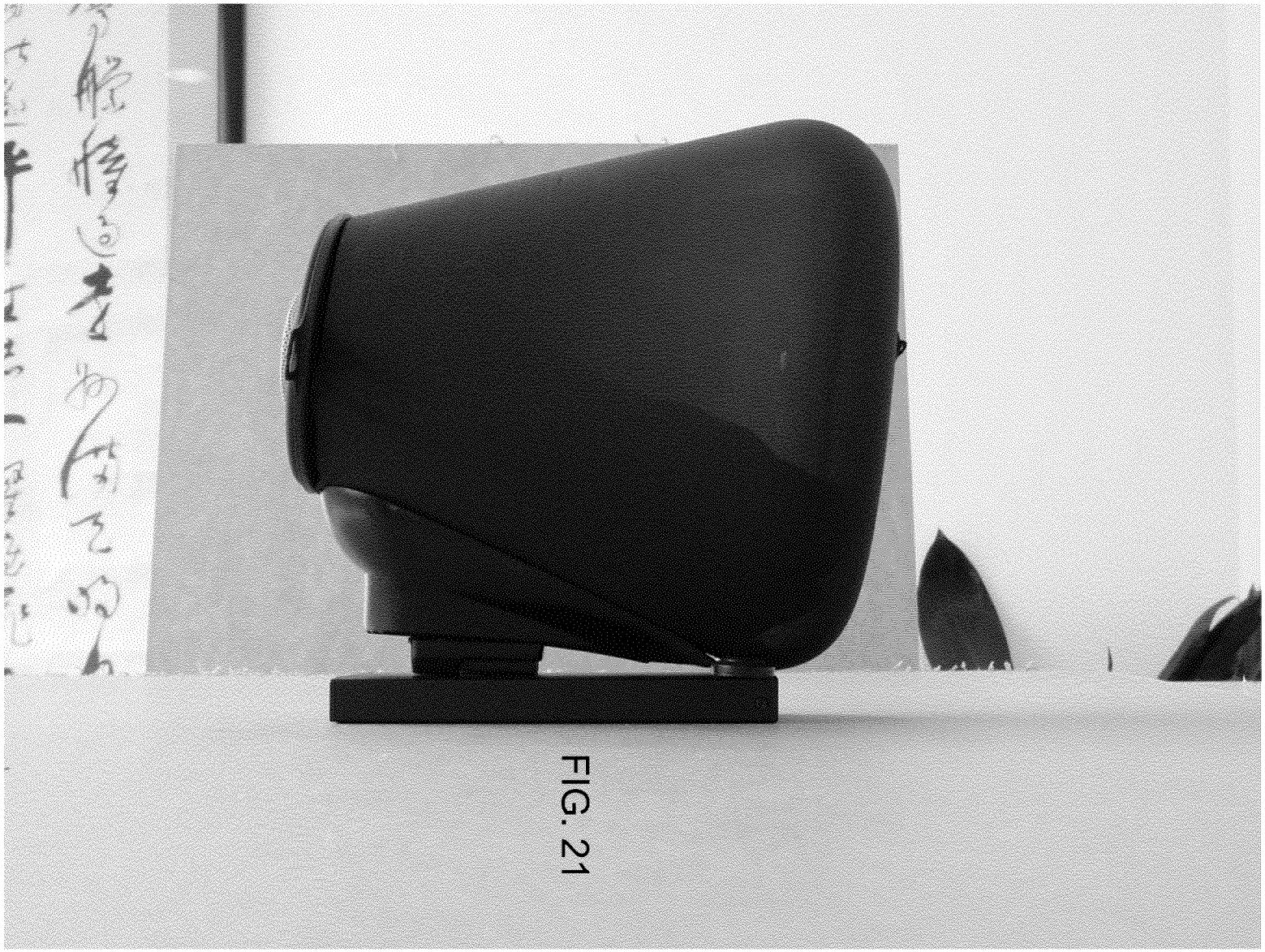
Figure 22:
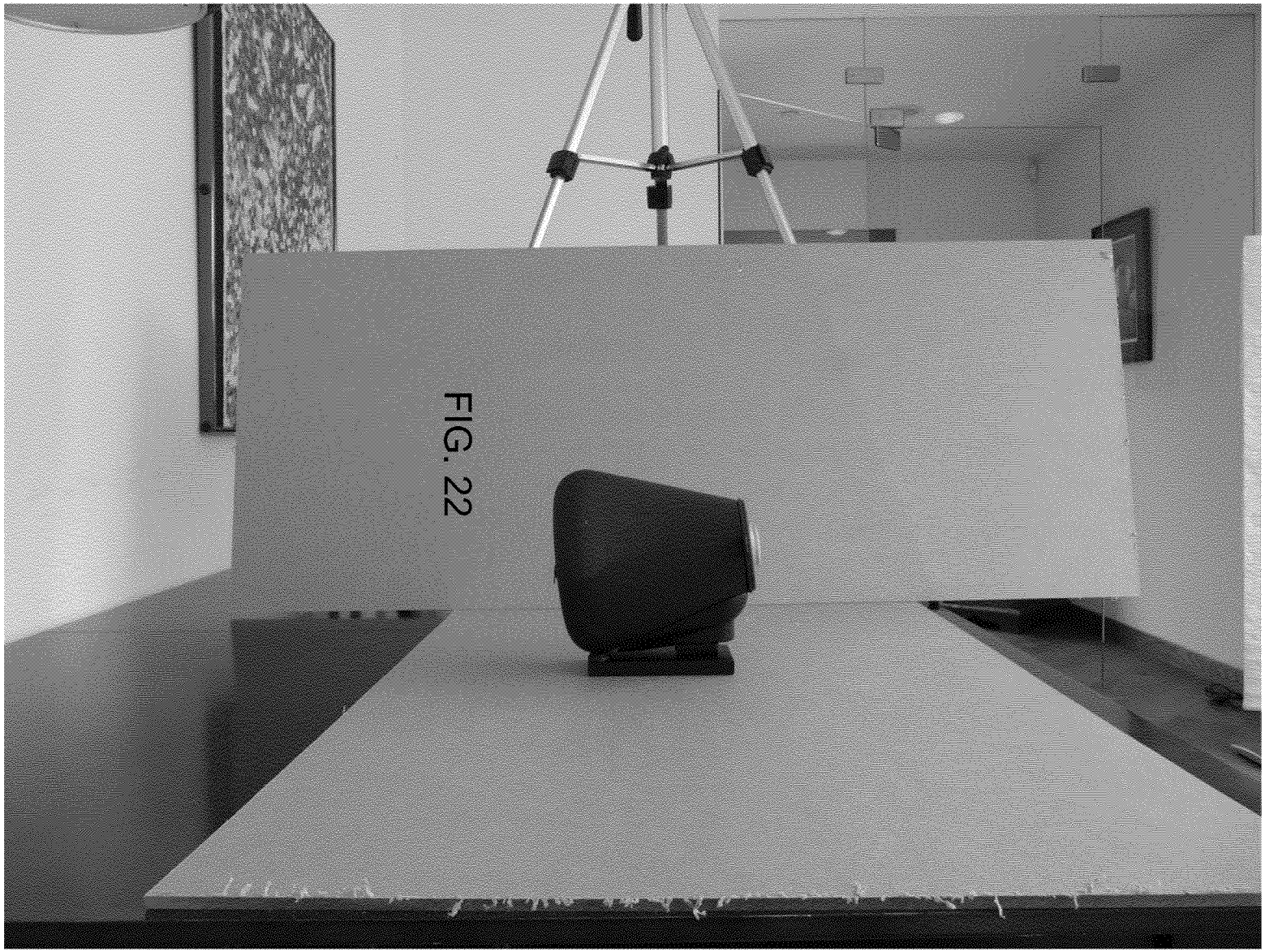
Figure 23:
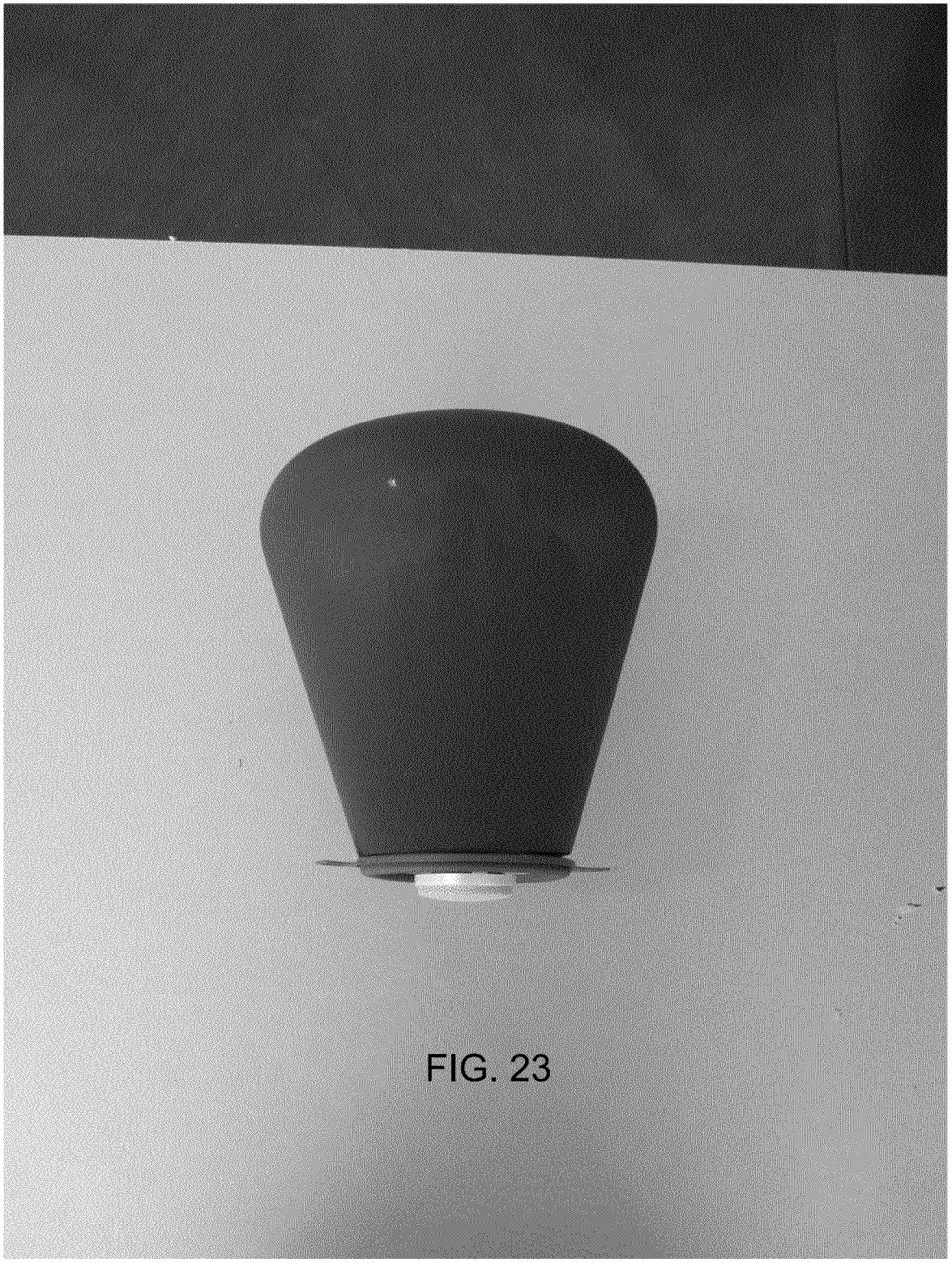
Figure 24:
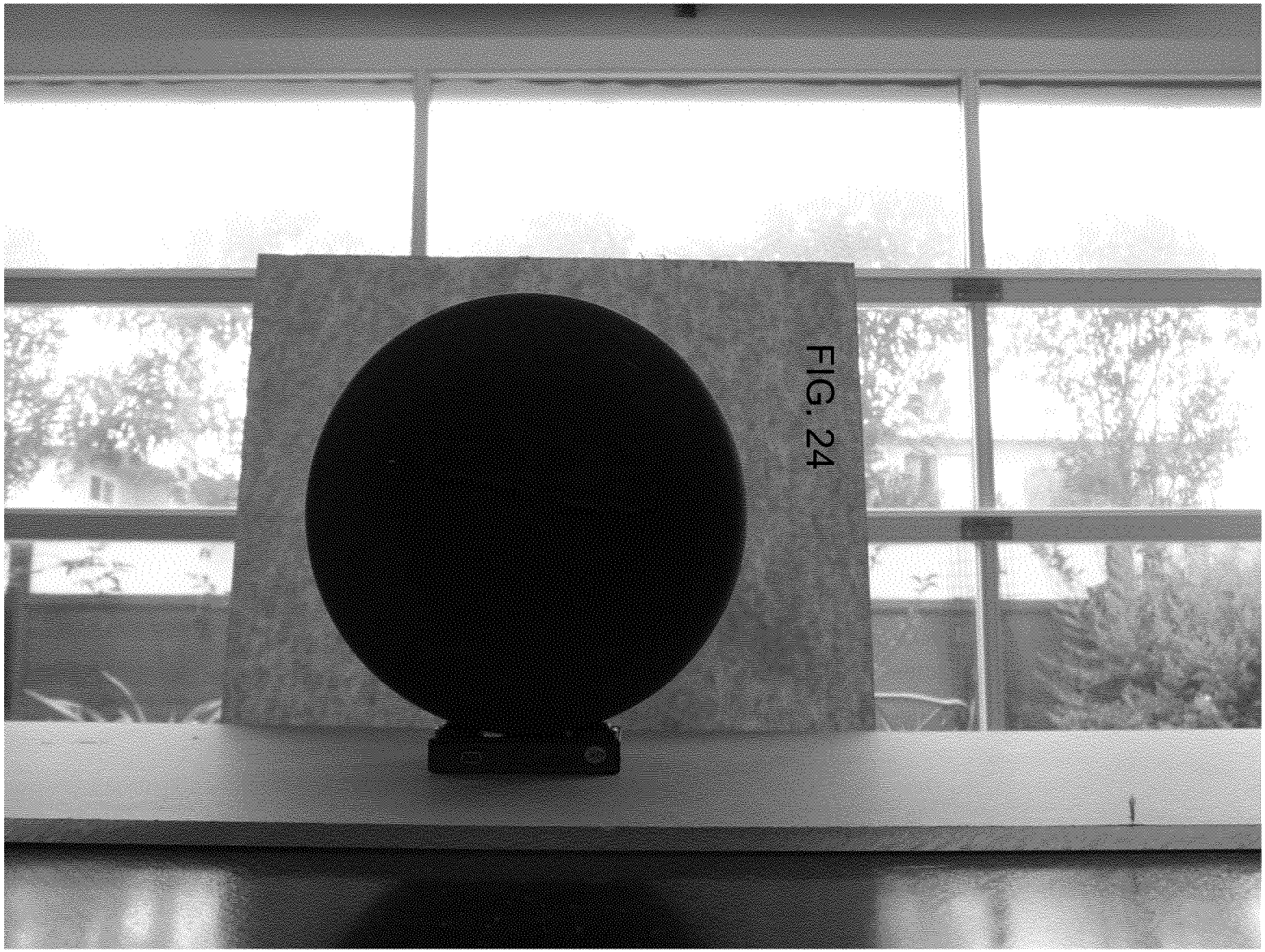

As can be seen in FIG. 6, the speaker enclosure 101 is not cylindrically shaped as shown in FIG. 2. FIG. 6 shows a speaker enclosure 101 that is in the shape of a conical flask, such as an Erlenmeyer flask typically used in a laboratory (this shape and the conical flask itself is hereinafter referred to as a "flask" or "flask shaped" or a "flask enclosure"). Flasks are commercially available in a multiplicity of shapes and sizes and materials. The conical flash may have a neck such as illustrated in FIG. 7, enclosure 800. Or the conical flak may be without a neck, that is, the flask has an opening at the first end and the walls of the flask extending generally directly and outwardly from the first end, increasing in diameter, to the second end. This is depicted in FIG. 11.

FIG. 7 shows a perspective view of the speaker system with two exemplary flask-shaped speaker enclosures 800, 802. It is appreciated that many other speaker enclosures comprising a variety of shapes, whether regular or irregular, and comprising a variety of materials are possible. Audio properties of the speaker system may be modified by way of different speaker enclosure shapes and materials.

With reference to FIGS. 6 and 7, in one example, the speaker enclosure is a conical flask, such as an Erlenmeyer flask having first end having an opening, and a second closed end with a diameter larger than the first end. The second end may be substantially flat and stable so as to form a base the supports the speaker system when it is placed on a table, floor, or the ground. This may be done, for example, when the speaker system is configured in a wireless/battery-operated mode.

FIGS. 11-24 show various views of exemplary speaker systems. FIG. 11 is an exemplary perspective view a speaker system comprising a first module 1100 and second module 1110. The first module 1100 comprises a conical borosilicate speaker enclosure 1101 with a single outwardly facing speaker 1102 oriented upwards. The speaker 1102 is a coaxial speaker. The speaker enclosure 1101 is of clear, conical borosilicate allowing the light source 1104, in this example an LED light, to illuminate the interior and exterior of the enclosure 1101. Damping material 1105 partially fills the enclosure.

FIG. 11 depicts the first module 1100 coupled to the second module 1110 without utilizing a hot shoe mount. The modules can be connected by way of, for example, a mechanical fastener, glue, epoxy, and the like, alone and in combination. The enclosure of the second module may be fabricated from rubber or equivalently include a rubber exterior or another insulating material thereby providing insulation between the first module 1100 and the second module 1110 without including an insulator (e.g. 106 of FIG. 1) as disclosed above.

The second module 1110 in FIG. 11 is generally triangular so that the speaker system (comprising the first module 1100, and the second module 1110 which includes hot shoe 206), may be mounted vertically to a second half mount. The speaker 1102 comprises a basket with two projections 1106 from which the speaker can be hung, suspended, or supported, for example, by two wires.

With this configuration, the speaker system in FIG. 11 can be mounted to a lamp by way of a lamp adapter, such as shown in FIG. 2. This permits speaker system to be placed within a prior art lamp shade. By directing the sound upwards in this manner, the speaker system minimizes the acoustic dampening and distortion that such a lampshade would otherwise cause. Further, the use of a transparent or translucent enclosure material such as borosilicate glass rather than traditional, nontransparent enclosure material such as wood, minimizes the light blocked by the speaker system and thus reduces shadows that a listener might find distracting and unattractive. To further minimize such shadowing, the first module 1100 includes a light source 1104 such as a LED light.

FIG. 12-24 show the same speaker system as shown in FIG. 11 coupled to a third module 130 and reoriented ninety degrees to rest on a surface, thereby utilizing the third module 130 as a base for the speaker system. Thus, the mounts and other elements that enable the speaker system to be utilized in connection with a prior art lamp assembly can be reconfigured to comprise a mobile, wireless speaker system. Viscoelastic urethane polymer washers 1211 attached to the third module 130 help to balance the enclosure 1101 and acoustically isolate it from the third module 130.

FIGS. 12, 18-24 shows the enclosure 1101 encased by a translucent fabric 1213. Alternately, the enclosure 1101 may be etched, sand-blasted, fumed, painted or otherwise modified depending on the desired aesthetics and the effect such alteration will have on the light emitted from light source 1104 or prior art lamp.

The speaker system may also comprise a different type of base that attaches to or supports the speaker enclosure. The base may comprise elements such as electronics and the battery disclosed above. In this way, one of the modules may also be a base.

FIG. 8 shows the speaker system including a base. In the illustration of FIG. 8 the speaker system is resting on a flat substantially horizontal surface 808, such as a table or floor. The first module 801 comprises the speaker enclosure. Connected near the second end of the speaker enclosure 801 are feet 816. The feet 816 may be non-slip, clear, rubber feet that help protect the second end of the speaker enclosure and reduce the possibility that the speaker enclosure will slip on or off of the horizontal surface 808.

A second module 806 comprising enclosure 812 and support member 814 form the base. The enclosure 812 comprises electronics and other elements thoroughly disclosed above. The support member 814 comprises a first end 818 connected to the enclosure 812, and a second end 820 shaped to support the first end (that is the end comprising the driver) of the first modules 801. In the example of FIG. 8 the second end is generally U-shaped to conform with contours of the first end of the speaker enclosure. However, the support member may comprise any variety of shapes. The support member 814 may be telescoping so that driver can be directed at angles greater than zero degrees relative to the surface the base is placed on.

The second end of support member 814 comprises a first half of a mount 816A. The first end of the speaker enclosure 810 comprises a second half of a mount 816B. The first half 816A and second half 816B mate when the first module 810 is supported by the second module 806. The output of an amplifier in enclosure 812 is electrically connected to the first half of the mount(s) 816A. The speaker 811 is electrically connected to the second half of the mount(s) 816B. Thus, when the first module 810 is supported by the second module 806, a circuit is completed that drives the speaker 811.

In another exemplary configuration, the support member of 814 of second module 806 is connected to the first module 810, for example by a collar, hot shoe mount, or other secure mount. In this configuration, the base can also be secured to a ceiling or wall by attaching the enclosure 812 to the desired surface (using any variety of commonly available connectors). The support member may be connected to enclosure 812 my way of a hinge, ball joint, or other mechanism thereby allowing the first module to be angled on at least one axis relative to the second module 812. In this way, the angle between the axis of the speaker and surface to which the second module 806 is mounted or resting on can take be adjusted.

The speaker enclosure is of a transparent material, such as glass. The glass may comprise any type of glass such as borosilicate glass. By way of example, other types of glass include, soda-lime glass, lead glass, aluminosilicate glass, ninety-six percent silica glass, and fused silica glass. The speaker enclosure may comprise these and other materials, whether glass or some other material. The audio properties of the speaker enclosure are dependent on at least the shape and dimensions of the speaker enclosure and its composition. The thickness of the walls of the enclosure may be constant or vary, for example, having a thin first end and thickening towards the second end. In one example the walls are between around 2 mm to around 10 mm thick.

The speaker enclosure may also be of blown glass, fumed glass, or art glass so that the speaker enclosure itself serves the multiple functions of a speaker enclosure and a work of art worthy of display. Those skilled in the art will appreciate that blown glass or equivalent is frequently purchased by collectors for their aesthetic beauty. Here, the aesthetic qualities are maintained while disguising a high fidelity speaker system.

The enclosure may further be translucent, as glass is sometimes made. The glass my be etched, in part or in whole. The enclosure may also comprise an opaque material such as stained glass. It is appreciated that the enclosure may be made of other materials in addition to, in combination with, or instead of glass. Some examples include, but are not limited to metals, plastics, resins, woods, ceramics, porcelain, and the like.

Turning back to FIG. 2, the first end of 200 of the enclosure comprises a first opening 203, and the second end of 202 of the enclosure 101 may comprise a second opening 205. The openings 203, 205 may be any shape. In one example the first opening 203 has a diameter approximately equal to the diameter of the first end 200. The second opening 205 has a diameter less than the diameter of the second end 205. While FIG. 2 shows a generally cylindrical enclosure 101, the enclosure may comprise any shape as disclosed above.

The first opening 203 is of sufficient size to secure the driver 102 to the enclosure 101. In one specific example, the first opening 203 is sufficiently sized so that the basket of the driver can be securely attached to an area of the enclosure proximal to the periphery of the first opening 203. Some exemplary ways to attach the driver to the enclosure include mechanical fasteners, glues, epoxies, threads, detents, other interlocking designs, and any combinations thereof. Generally, the driver comprises a diaphragm supported by a rigid chassis (also referred to herein as a frame or basket) by cone surround (also referred to as a suspension rim) made of rubber, foam or fabric. The suspension rim is attached to the outer diaphragm circumference and to the frame. Also, connected to the basket is a coil and magnet. This is just one type of driver design described in the most general terms, and those skilled in the art will appreciate that many different types of drivers can be used. A driver such as this, that is a driver that is driven by an amplified signal, may also be referred to as an active driver.

Other ways of fastening the driver to the enclosure include bonding the periphery of the suspension rim to the periphery of the opening. The coil, magnet, and any other elements that may comprise the driver may be attached to the interior of the enclosure at a position that couples the driver's elements to the diaphragm. Yet another way to connect the driver to the enclosure is illustrated in FIG. 2. A sleeve, such as a plastic or rubber sleeve, is attached to the basket. The sleeve is sized so that it fits over the exterior portion of the first end. The sleeve is positioned over the exterior portion of the first end, causing at least a portion of the driver to be positioned in the interior of the enclosure and outermost edge of the diaphragm to be approximately flush with the boundary of the first end. The sleeve is then bonded, such as with clue, to the enclosure.

As disclosed above, the speaker enclosure may comprise a second opening 205. A tuning port 208 extends from the exterior surface through the interior surface of the enclosure 101 by way of the second opening 205. One end of the tuning port 205 is attached to the second opening 205 as disclosed above with reference to attaching the driver 102 to the first end 200.

In another example, a passive radiator is attached to the second end 202 at the opening 202. Passive radiators (also referred to herein as passive drivers) are commercially available. In its simplest form, a passive radiator comprises a diaphragm supported by a basket through a suspension rim. Such a passive drive is attached to the second end by any of the ways disclosed above for attaching the driver 102 to the first end 200. Also, a baffle may be included in the interior of the speaker enclosure between the first end and the second end.

While only one active driver and one passive radiator has been described, additional active and passive drivers may be included in the speaker system. Additional drivers and ports may be mounted at an intermediate section 204 of the enclosure. Or, the speaker system may include an additional module comprising an additional enclosure which mounts to one of the other modules. The additional enclosure may be different in shape, materials, design, and the like from the first enclosure, and may be made as a complement to the first enclosure. The two modules may be designed to enhance both the sonic attributes and visual qualities of the speaker system.

Turning back to FIGS. 2, 4 and 5 and the associated description above, the speaker system may include a light source 414 such as an LED. With reference to FIG. 11, the light source 1104, for example, may be integrated within the interior of the speaker enclosure 1101. In this example, the speaker enclosure 1101 is a transparent speaker enclosure.

The light source receives power from the battery 412 as already disclosed. In one example the light source 414 is attached interiorly to the speaker enclosure 101. For example, the light source 414 is attached to the driver's frame and positioned in a direction towards the second end 202. In another example, the light source 414 is attached so light is directed generally radially away from the prior art lamp 10, 20.

The speaker system disclosed above is modular and configurable, portable and wireless. One module can be substituted with another module to provide different or additional features. For example, the module comprising the amplifier could by replaced by a module comprising a different amplifier design, thereby enabling a user to customize their speaker system in a quick and easy way.

The speaker system is aesthetically pleasing, as much so as even the best of art glass. In this way, the speaker system can be hidden in any room, and displayed as a genuine work of art.

The speaker system is able to beneficially use the floor (or ceiling) as a diffuser, enhancing the sound stage and helping create an all-encompassing sonic experience that is difficult to achieve with conventional point source-type speakers. Conventional point-source speakers must be pointed towards the listener for achieve best sound quality. The present speaker system may be positioned in any direction according to the preferences of the user, such that the audio is experienced more directionally or more omnidirectionally, or some heretofore not possible combination of directional and omnidirectional.

The speaker system may be mounted in many different ways and may be connected to or used as a lamp. Connected to a lamp, the speaker system is somewhat invisible due how it is mounted to the lamp and because the speaker enclosure is made of glass; most of the light from the prior art light lamp passes through the glass speaker enclosure.

A light source (414) may be integrated within the speaker enclosure. The light source renders the speaker system all the more invisible when attached to a prior art lamp; any shadows cast by a portion of the speaker enclosure blocking the prior art lamp's light is minimized or is effectively "replaced" by the light source (414).

The unconventional speaker enclosure like the conical flask made of borosilicate glass, and mounting the active driver at an unconventional position at the opening of the first end (the narrower end) of the enclosure, projects the audio faithfully, ambiently, and without many of the resonance problems, phase issues, and frequency absorption annoyances that plague prior art speaker systems.

Finally, the speaker enclosure may include speaker terminals such as disclosed above and, in this way, the driver may be externally driven by prior art audio components.

The foregoing detailed description has discussed only a few of the many forms that this invention can take. It is intended that the foregoing detailed description be understood as an illustration of selected forms that the invention can take and not as a definition of the invention. It is only the following claims, including all equivalents, that are intended to define the scope of this invention.

What is claimed is:

1. A speaker system comprising: (a) at least one mount having two halves comprising a first half mount comprising electrical contacts, and a second half mount comprising electrical contacts that align with the electrical contacts of the first half of each of the at least one mounts when the first half and the second half are connected to each other; (b) a plurality of electronic elements comprising an audio receiver, an amplifier, and a power supply; (c) a plurality of modules comprising, (i) a first module comprising, a speaker enclosure having a first end comprising an opening, a second end, an intermediate section connecting the first end to the second end, an exterior surface, and an interior surface that defines the interior of the speaker enclosure; a driver attached to the opening of the first end of the speaker enclosure; at least one half of at least one mount of (a) connected to the speaker enclosure, wherein the driver is electrically coupled to electrical contacts of the at least one half; (ii) at least one additional module, each additional module comprising, an enclosure; at least one half of at least one mount connected to the enclosure; at least one of the electronic elements enclosed by the enclosure and electrically coupled to electrical contacts of the at least one half of at least one mount of (a); and (d) wherein each of the plurality of modules is mechanically attached to at least one other module, wherein the plurality of modules are mechanically attached when a module's first half mount is attached to another module's second half mount.

2. The system of claim 1 wherein the audio receiver is electrically coupled to the amplifier, the amplifier is electrically coupled to the driver, and the power supply is electrically coupled to supply power at least the amplifier.

3. The system of claim 1 wherein the power supply comprises a battery.

4. The system of claim 2 wherein the plurality of electronic elements further comprises a power adapter, wherein the power adapter is electrically coupled to the battery.

5. The system of claim 1 wherein each of the at least one of the mounts in (a) comprise a hot shoe mount.

6. The system of claim 1 further comprising an insulator attached between the speaker enclosure and the at least one half of at least one mount in (d).

7. The system of claim 1 wherein the first module is suspended from a ceiling, and the at least one additional module comprises a diffuser suspended above the first end of the speaker enclosure, wherein the diffuser encloses at least some of the plurality of electronic elements.

8. The system of claim 6 wherein a distance between the first end of the speaker enclosure and the diffuser is adjustable.

9. The system of claim 1 wherein at least one of the additional modules is a lamp adapter.

10. The system of claim 9 wherein the lamp adapter is connected to a light fixture configured to be connected to a ceiling.

11. The system of claim 10 where the speaker enclosure hangs from the light fixture, and further comprising a diffuser suspended above the first end of the speaker enclosure.

12. The system of claim 9 wherein the lamp adapter is configured to be attached to a lamp base and accept a light bulb.

13. The system of claim 1 wherein the first module is connected to a wall.

14. The system of claim 1 wherein the second end of the speaker enclosure forms a base that supports the first module.

15. The system of claim 1 wherein at least of one the additional modules is a base that supports the first module.

16. The system of claim 1 wherein the first module is positioned in at least one of the following orientations: vertically so that the first end of the speaker enclosure is directed up, vertically so that the first end of the speaker enclosure is directed down, and at an angle between horizontal and vertical.

17. The system of claim 1 wherein the second end of the speaker enclosure comprises an opening.

18. The system of claim 17 further comprising at least one of the following attached to the opening of the second end: a passive radiator, an active driver wherein the output of the amplifier is electrically coupled to the active driver, a diaphragm, and a tuning port that extends at least partially into the interior of the speaker enclosure.

19. The system of claim 1 wherein the speaker enclosure comprises the shape of a conical flask.

20. The speaker of claim 1 wherein the conical flask does not have a neck.

21. The system of claim 1 wherein the plurality of electronic elements comprises a light source, wherein the light source is attached to the first module and electrically coupled to the power supply.

22. The system of claim 21 wherein the speaker enclosure is at least in part transparent and the light source is attached to the interior of the speaker enclosure.

23. The system of claim 1 further comprising a baffle enclosed by the speaker enclosure.

24. The system of claim 1 wherein the speaker enclosure comprises at least one of the following: glass; borosilicate glass; a transparent material; a translucent material; an opaque material; an etched material; etched glass; fumed glass; and blown glass.

25. The system of claim 1 further comprising, a pass-through connection electrically coupling some of the electrical contacts of one half of a mount connected to an enclosure of one of the plurality of modules to some of the electrical contacts of another half of a mount connected to the same enclosure.

26. The system of claim 1 wherein the audio receiver comprises speaker terminals.

27. The system of claim 1 wherein the audio receiver comprises at least one of, a wireless transceiver, and an audio decoder.

28. The system of claim 1 further comprising a diffuser positioned above the driver.

29. A speaker system comprising: (a) at least one mount having two halves comprising a first half mount comprising electrical contacts, and a second half mount comprising electrical contacts that align with the electrical contacts of the first half of each of the at least one mounts when the first half and the second half are connected to each other; (b) a plurality of electronic elements comprising an audio receiver, an amplifier, and a power supply; (c) a plurality of modules comprising, (i) a first module comprising, a conical flask-shaped speaker enclosure having a first end comprising an opening, a second end, an intermediate section connecting the first end to the second end, an exterior surface, and an interior surface that defines the interior of the speaker enclosure; a driver attached to the opening of the first end of the speaker enclosure; at least one half of at least one mount of (a) connected to the speaker enclosure, wherein the driver is electrically coupled to electrical contacts of the at least one half; (ii) at least one additional module, each additional module comprising, an enclosure; at least one half of at least one mount connected to the enclosure; at least one of the electronic elements enclosed by the enclosure and electrically coupled to electrical contacts of the at least one half of at least one mount of (a); and (d) wherein each of the plurality of modules is mechanically attached to at least one other module, wherein the plurality of modules are mechanically attached when a module's first half mount is attached to another module's second half mount.

30. The speaker system of claim 29 wherein the at least one additional module comprises at least one of: means for receiving audio, means for amplifying audio, mean for wirelessly receiving and transmitting data, means for driving an active driver, means for connecting modules, means for supplying power, and means for regulating power.

31. The speaker system of claim 29 wherein the speaker enclosure is glass.

32. The speaker system of claim 29 wherein the first module further comprises a light source in the interior of the speaker enclosure.

* * * * *